US010286516B2

(12) United States Patent
Ishikawa et al.

(10) Patent No.: US 10,286,516 B2
(45) Date of Patent: May 14, 2019

(54) POLISHERS

(71) Applicant: MAKITA CORPORATION, Anjo-shi, Aichi (JP)

(72) Inventors: Junya Ishikawa, Anjo (JP); Satoshi Ninagawa, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 246 days.

(21) Appl. No.: 15/287,530

(22) Filed: Oct. 6, 2016

(65) Prior Publication Data

US 2017/0106491 A1 Apr. 20, 2017

(30) Foreign Application Priority Data

Oct. 15, 2015 (JP) ..... 2015-203916
Apr. 4, 2016 (JP) ..... 2016-075187
Oct. 5, 2016 (JP) ..... 2016-197370

(51) Int. Cl.
*B24B 23/02* (2006.01)
*B24B 23/03* (2006.01)
*B24B 37/20* (2012.01)

(52) U.S. Cl.
CPC ..... *B24B 23/02* (2013.01); *B24B 23/03* (2013.01); *B24B 37/20* (2013.01)

(58) Field of Classification Search
CPC ..... B24B 23/02; B24B 23/03; B24B 23/04
See application file for complete search history.

(56) References Cited

U.S. PATENT DOCUMENTS 3,874,125 A * 4/1975 Stroezel ..... B24B 23/04 15/22.1
4,748,755 A * 6/1988 Bain, Jr. ..... D06F 75/14 219/245
5,357,715 A * 10/1994 Hiramatsu ..... B24B 23/03 451/357
5,390,433 A * 2/1995 Brady ..... D06F 75/28 219/256
7,115,018 B1 * 10/2006 Syverson ..... B24B 23/02 451/6
7,614,902 B2 * 11/2009 Bayat ..... F21L 14/023 38/88
8,172,642 B2 * 5/2012 King ..... B24B 23/03 451/8
8,716,908 B2 * 5/2014 Takeda ..... B24B 23/02 310/50

FOREIGN PATENT DOCUMENTS

JP 2004-122337 A 4/2004

* cited by examiner

*Primary Examiner* — Timothy V Eley
(74) *Attorney, Agent, or Firm* — Oliff PLC

(57) ABSTRACT

A polisher may include a polishing pad, a motor, a transmission device, and a mode selection device. The transmission device can transmit a rotational drive force of the motor to the polishing pad in a plurality of different modes with respect to a motion of the polishing pad. The mode selection device may be used for selecting a desired motion mode of the output member. Additionally, a motor and handle housing with an accompanying power cord may be constructed to aid in ease of manipulation of the polisher by the user with minimal interference.

17 Claims, 18 Drawing Sheets

POLISHERS

CROSS-REFERENCE TO RELATED APPLICATIONS

This application is based upon and claims priorities to Japanese Patent Application Serial No. 2015-203916 filed on Oct. 15, 2015, Japanese Patent Application Serial No. 2016-075187 filed on Apr. 4, 2016, and Japanese Patent Application Serial No. 2016-197370 filed on Oct. 5, 2016, the contents of which are incorporated in their entirety herein by reference.

BACKGROUND

Technical Field

The invention generally relates to polishers that may be used for polishing target surfaces to be polished, such as painted or coated surfaces of articles, machines or equipments.

Related Art

Japanese Laid-Open Patent Publication No. 2004-122337 (JP-A-2004-122337) discloses a polisher including a built-in motor as a drive source. The rotational force generated by the motor may be transmitted to an output shaft, to which a polishing pad may be attached. The attached polishing pad may rotate with the output shaft for polishing a target surface to be polished. The polishing pad may be detachable to the output shaft. Therefore, the user can selectively use a suitable pad from different types of polishing pads in accordance with a desired polishing mode.

There is a need in the art for a technique of enabling a plurality of polishing modes without needing to change a polishing pad.

SUMMARY

In one aspect according to the present teachings, a polisher may include a polishing pad, a motor, a transmission device, and a mode selecting device. The transmission device can transmit a rotational drive force of the motor to the polishing pad in any one of a plurality of different modes, to accordingly effect motion of the polishing pad. The mode selecting device may allow selection of a desired motion mode of the polishing pad.

In one embodiment, a polisher may include a polishing pad, a motor, an output member, and a transmission device. The polishing pad may have a polishing surface and may be used for polishing a target surface. The output member may be coupled to the polishing pad. The motor may generate a rotational drive force. The transmission device may transmit the rotational drive force to the output member in any one of a plurality of different modes with respect to effecting motion of the output member. A mode selection device may be coupled to the transmission device and may allow selection of a motion mode from a plurality of different modes, such that a desired motion mode for the output member may be selected. The polisher may further include a transmission housing that supports or accommodates the transmission device. The mode selection device may also be disposed in the transmission housing. The polishing pad may be detachably attached to the output member or alternatively may be integrated with the output member.

This manner of construction and arrangement of the polisher enables the user to select a desired mode from the plurality of different modes to effect motion of the output member coupled to the polishing pad. Therefore, a variety of polishing modes are available for the user without needing to change of the polishing pad.

The plurality of different modes may include a first mode and a second mode. The first mode may cause the output member to revolve about a first axis and to freely rotate about a second axis displaced from the first axis. The second mode may cause the output member to revolve about the first axis and to forcibly rotate the output member about the second axis. In this way, the user can select a free rotation mode or a forced rotation mode with respect to the rotation of the output shaft (i.e., the rotation of the polishing pad) about the second axis, while the output shaft revolves about the first axis.

The transmission device may include a support shaft portion rotatably driven about the first axis by the rotational drive force of the motor. An eccentric shaft portion may be rotatable with the support shaft portion about the first axis and may further rotate about the second axis. The output member may be coupled to the eccentric shaft portion so as to be rotatable along with the eccentric shaft portion about the second axis. The output member may include an external gear portion. An internal gear member may be rotatable about the first axis relative to the transmission housing and may include an internal gear portion that is in engagement with the external gear portion of the output member. The mode change device may include an engaging member movable between an engaging position and a disengaging position. The internal gear member may include an engagement portion for engagement with the engaging member of the mode change device. The first mode of the mode change device may cause its engaging member to be disengaged from the engaging portion of the internal gear member, so that the output member is allowed to freely rotate about the second axis while the output member revolves about the first axis. The second mode of the mode change device may cause its engaging member to engage the engaging portion of the internal gear member, so that the output member is forced to rotate about the second axis while the output member revolves abut the first axis.

The internal gear member may further include an engagement prohibiting portion configured to prohibit engagement of the engaging member of the mode change device with the engaging portion of the internal gear member when the engaging member moves from the disengaging position to the engaging portion while the internal gear member rotates at a speed higher than a predetermined speed.

For example, if the internal gear rotates at a relatively high speed when the mode selection device is operated to change the motion mode from the first mode (i.e., the free rotation mode) to the second mode (i.e., the forced rotation mode), the engaging member of the mode change device may abruptly engage the engaging portion of the internal gear member. If this occurs, the engaging member and/or the engaging portion may be damaged. The engagement prohibiting portion may prohibit engagement of the engaging member with the engaging portion when the internal gear member rotates at a speed higher than the predetermined speed. In light of the above, doing so may prevent potential damage to the mode changing device and/or internal gear member, and further may extend the lifetime of the polisher.

The engagement prohibiting portion of the internal gear member may be disposed proximally, relative to the engaging portion, in a rotational direction, and may include a surface inclined outward in a direction opposite to the rotational direction.

With this arrangement of the engagement prohibiting portion, as the engaging member of the mode changing device moves from the disengaging position to the engaging position when the internal gear member rotates at a speed higher than the predetermined speed, the engaging member is prevented from contacting the engaging portion. Instead, the engaging member contacts the inclined surface of the engagement prohibiting portion and may move away from the internal gear along the inclined surface as the internal gear member rotates further. Therefore, it is possible to prevent the engaging member from engagement with the engaging portion. When the rotational speed of the internal gear is reduced to be lower than the predetermined speed, the engaging member may move along the inclined surface toward the internal gear and may automatically engage the engaging portion. In this manner, it is possible to prevent potential damage to the engaging member of the mode changing device and/or the engaging portion of the internal gear member, by providing the inclined surface on the internal gear member.

The engaging portion of the internal gear member may be a plurality of engaging grooves formed in an outer circumferential surface of the internal gear member. The engaging member of the mode changing device may be an engaging pin movable between the engaging position and the disengaging position in a radial direction with respect to a rotational axis of the internal gear member.

With this arrangement, the engaging pin of the mode selection device moves in the radial direction toward and away from the internal gear member and may be disposed on a radially outer side of the internal gear member. Due to the movable pin arrangement, it may be possible to minimize the size of the combination of the internal gear member and the mode change device in the axial direction of the internal gear member. Because the mode selection device is disposed in the transmission housing that may support the internal gear member, where the combination of both may be minimized as described, it is possible to minimize the size of the transmission housing in the axial direction, and by extension, it is therefore possible to minimize the size of the polisher in the axial direction, where said axial direction may be a vertical direction.

Alternatively, the plurality of engaging grooves of the engaging portion may be formed in one of the opposite surfaces in the axial direction of the internal gear member, and the engaging pin of the mode selection device may move between the engaging position and the disengaging position in an axial direction parallel to a rotational axis of the internal gear member.

The circumferential speed of the engaging portion formed in one of the opposite surfaces in the axial direction of the internal gear member may be naturally lower than the circumferential speed of the outer circumferential surface of the internal gear member. In addition, the circumferential speed of the engaging portion formed in this way may become lower as the position of the engaging portion approaches the rotation center of the internal gear member. Therefore, a freedom in design with respect to the circumferential speed of the engaging portion may be achieved.

In another embodiment, a polisher may include a polishing pad, a motor housing, a handle housing and a power cord. The polishing pad may have a polishing surface that can polish a target surface. The motor housing may accommodate a motor that may serve as a drive source of the polishing pad. The handle housing may be disposed on a rear side of the motor housing and configured to be grasped by user's hands. The motor housing may have a longitudinal axis that extends substantially parallel to the polishing surface of the polishing pad. The power cord may be electrically connected to the motor and may extend in an extending direction from within a rear portion of the handle housing to an outside of the handle housing. The extending direction of the power cord may be inclined relative to the longitudinal axis by a predetermined angle such that the power cord extends upward away from the polishing surface in a rearward direction.

With this arrangement of the polisher's various components and the extending direction of the power cord, it is possible to inhibit or minimize occasions where the power cord accidentally contacts a surface of a target to be polished during the polishing operation. As a result, the polishing operation can be quickly performed to achieve a fine finish of the target surface without undesired interference by the power cord contacting the target surface.

Further, in some cases, for the purpose of avoiding the power cord from contacting the target surface, the user may hang a part of the power cord of the polisher on his or her shoulder while performing the polishing operation. In this case, due to the extending direction, resulting in the upward inclination of the power cord from the rear portion of the handle housing, it may be possible to prevent a portion of the power cord extending between the rear portion of the handle housing and the shoulder of the user from being abruptly bent or curved. Therefore, with this mode of construction, it is possible to prevent potential breakage of wires of the power cord.

The aforementioned predetermined angle may lie within a range of about 5 to 90 degrees, preferably within a range of about 10 to 60 degrees, and more preferably 15 degrees.

In a further embodiment, a polisher may include a polishing pad, a motor housing, a handle housing, a power cord and a holding sleeve. The polishing pad may have a polishing surface that can polish a target surface to be polished. The motor housing may accommodate a motor serving as a drive source of the polishing pad. The handle housing may be disposed on a rear side of the motor housing and configured to be grasped by a hand of a user. The motor housing may have a longitudinal axis that extends substantially parallel to a polishing surface of the polishing pad. A power cord may be electrically connected to the motor and may extend in an extending direction from within a rear portion of the handle housing to an outside of the handle housing. A holding sleeve may be pivotally attached to the rear portion of the handle housing, such that a tilt angle of the holding sleeve in a vertical direction relative to the polishing surface is adjustable. The power cord may extend from the rear portion of the handle housing to the outside of the handle housing through the holding sleeve.

With this arrangement, it may also be possible to inhibit or minimize occasions where the power cord contacts a surface of a target to be polished during the polishing operation, by positioning the holding sleeve to be tilted upward. As a result, the polishing operation can be quickly performed to achieve a fine finish of the target surface without undesired interference by the power cord contacting the target surface. Further, because the tilt angle of the holding sleeve in a vertical direction relative to the polishing surface can be changed, it may be possible to adjust the upward inclination angle, for example, depending on a posture of the user taken during the polishing operation. As a result, it may be possible to further reliably inhibit or minimize such an occasion that the power cord contacts the target surface to be polished, during the polishing operation. Further, it may be possible to further reliably prevent the power cord from being abruptly bent or curved, whereby it may be possible to further reliably prevent potential breakage of wires of the power cord.

DETAILED DESCRIPTION OF THE PRESENTLY PREFERRED EMBODIMENTS

First Embodiment

Figure 1:
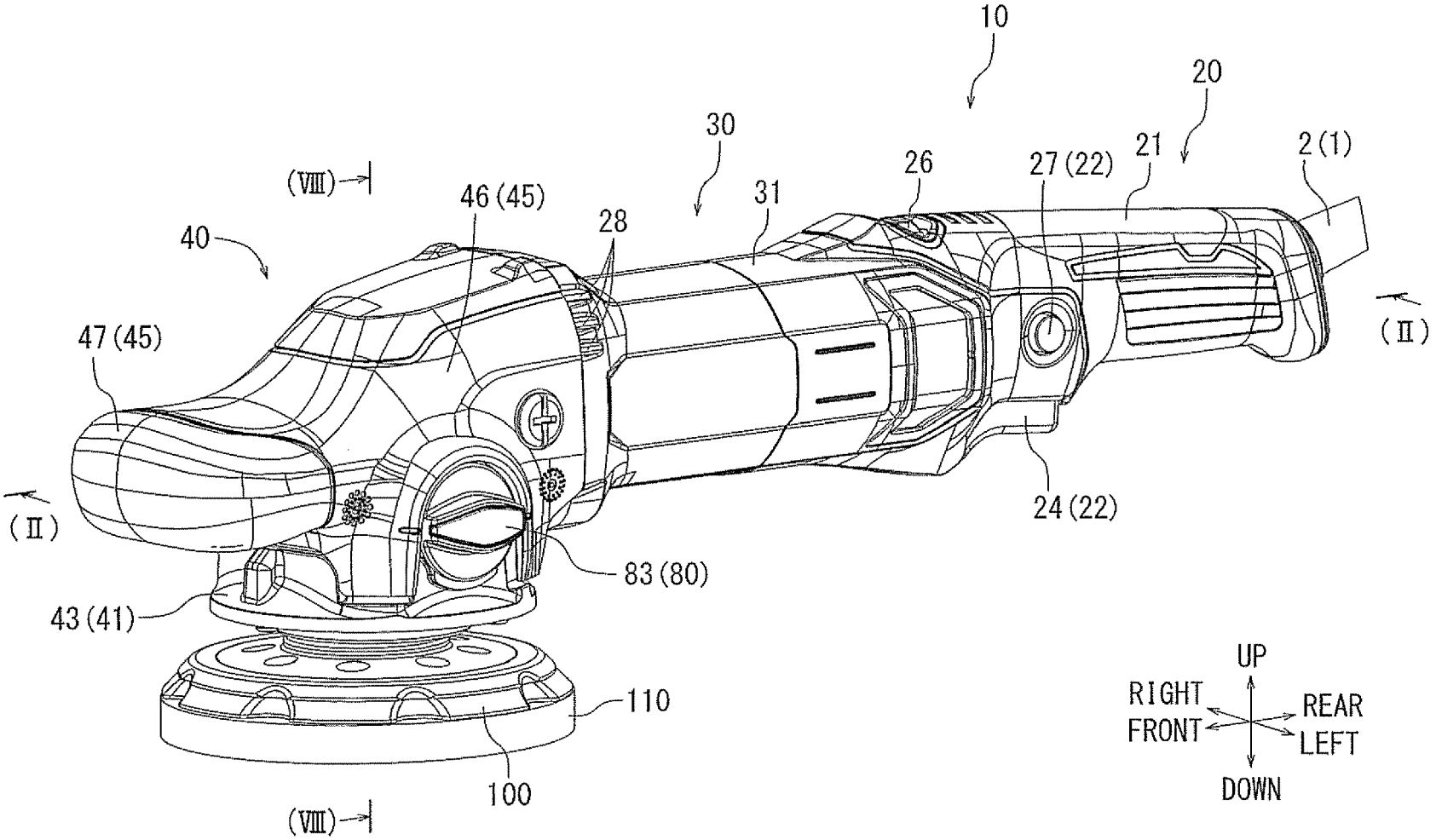
FIG. 1 is a perspective view of a polisher according to a first embodiment.

A polisher 10 according to a first embodiment will now be described with reference to FIGS. 1 to 12. The polisher 10 may be used for polishing surfaces to be polished, such as painted or coated surfaces of articles, machines and equipments (hereinafter called "target surfaces"). The polisher 10 may include a built-in motor 32 that generates a rotational drive force. The rotational drive force of the motor 32 may be transmitted to an eccentric shaft 61. The eccentric shaft 61 may rotatably support an output member 65. A polishing pad 100 may be detachably attached to the output member 65 by using a screw 105. A polishing sponge 110 may be detachably attached to the lower surface of the polishing pad 100 via an attaching device. The attaching device may be a suitable fastener, such as a hook and loop fastener known as a "Velcro" (registered trademark) fastener. The fastener may include a first fastener member 107 and a second fastener member 108. The first fastener member 107 may be fixedly attached to the lower surface of the polishing pad 100. The second fastener member 111 may be fixedly attached to the upper surface of the polishing sponge 110 for engagement with the first fastener member 107. Engagement between the first fastener member 107 and the second fastener member 111 may attach the polishing sponge 110 to the polishing pad 100, so that the polishing sponge 110 may rotate with the polishing pad 100 for polishing the target surfaces. Any other polishing element than the polishing sponge 110 may be used as a polishing material. For example, a woolen fabric may be used in place of the polishing sponge 110.

Figure 7:
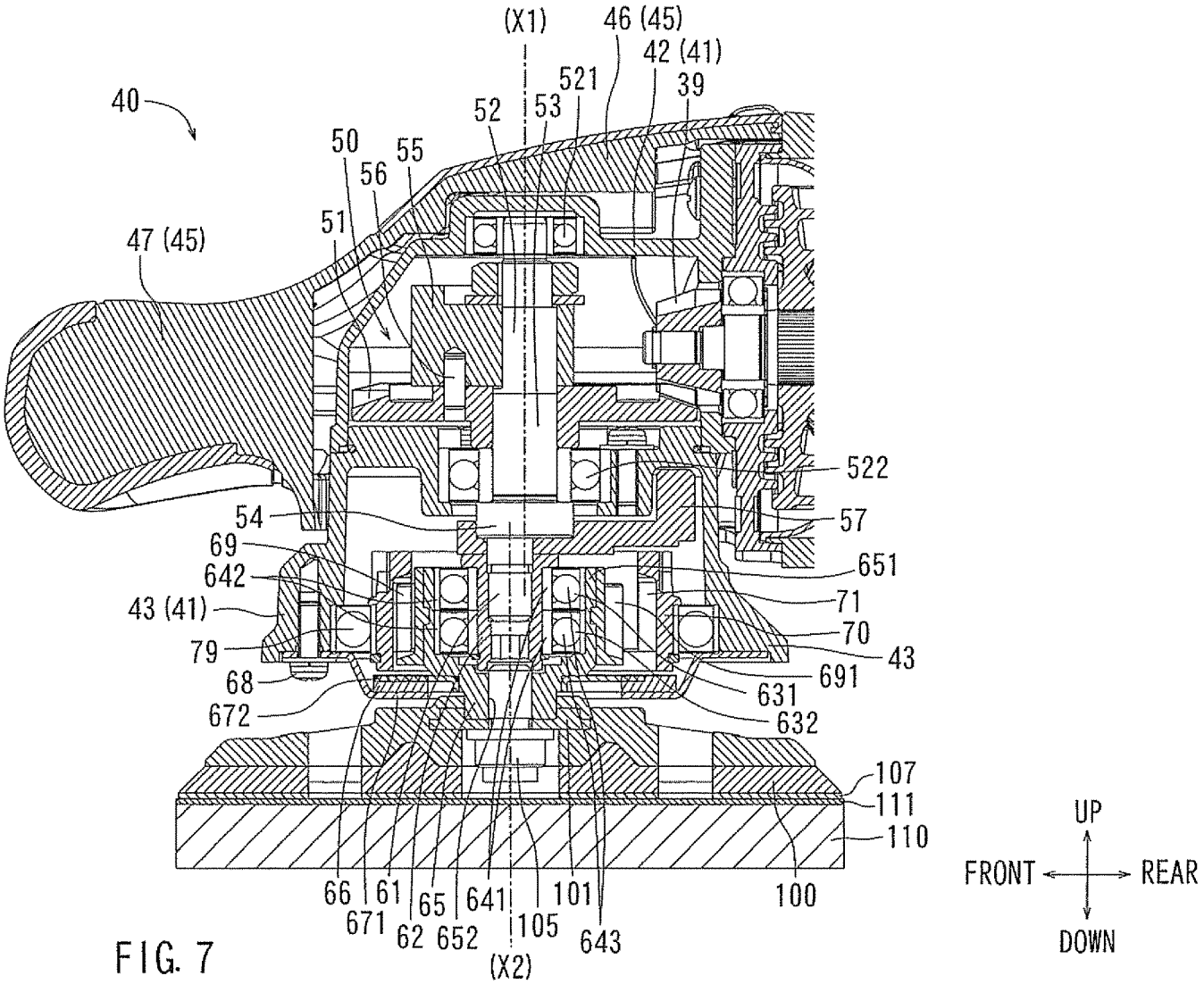
FIG. 7 is an enlarged view of a part of FIG. 2 showing a gear unit.

As will be explained later, the polishing pad 100 may make an eccentric motion (i.e. revolution) together with the eccentric shaft 61 about an axis X1 while also rotating relative to the eccentric shaft 61 about an axis X2 that may be offset or displaced from the axis X1 in the direction of the front-rear axis (see FIGS. 2 and 7). Further, a mode selection device 80 may be manually operable for selection between a forced rotation mode and a free rotation mode with respect to the rotation of the polishing pad 100 about the axis X2.

Referring to FIG. 1, the polisher 10 may generally include a handle 20, a motor portion 30 and an output gear portion 40 that are arranged along a substantially straight line in the order from rear to front in FIG. 1. The handle 20 may include a handle housing 21 with a right housing half 21R and a left housing half 21L that are joined together at a vertical joint plane (see FIGS. 4 and 5). The handle housing 21 may have an outer shape suitably designed for allowing the handle housing 21 to be grasped by the user.

As shown in FIG. 1, a switch device 22 may be disposed at the handle housing 21 and may be manually operated for starting and stopping the motor 32. The switch device 22 may include a switch main body 23 and a trigger 24. The switch main body 23 may be disposed within the handle housing 21 and may be a contact switch device. The trigger 24 may be mounted to (connected to) the switch main body 23 and may be partly exposed to the outside from the handle housing 21. More specifically, the trigger 24 may be positioned such that it can be operated or pulled by a finger(s) of the user when the user grasps the handle 20. When the user pulls the trigger 24 to move the trigger 24 from an off-operation position to an on-operation position, the switch main body 23 may be turned on, starting the motor 32. A lock-on button 27 may be disposed at the left side portion of the handle housing 21. The lock-on button 27 may be coupled to the switch device 22 such that the trigger 24 may be locked into the on-operation position when the user pushes the lock-on button 27 with the trigger 24 in the on-operation position. Therefore, even in the case when the user releases the pulling force applied to the trigger 24 to initially move it to an on-operation position, the trigger 24 may be held in said position, so that the switch main body 23 will continue to remain on. Hence, the user can continue the polishing operation in a comfortable position with his or her finger(s) removed from the trigger 24. Pushing the lock-on button 27 again may release the lock state of the trigger 24, so that the rotation of the motor 32 can be stopped.

Figure 2:
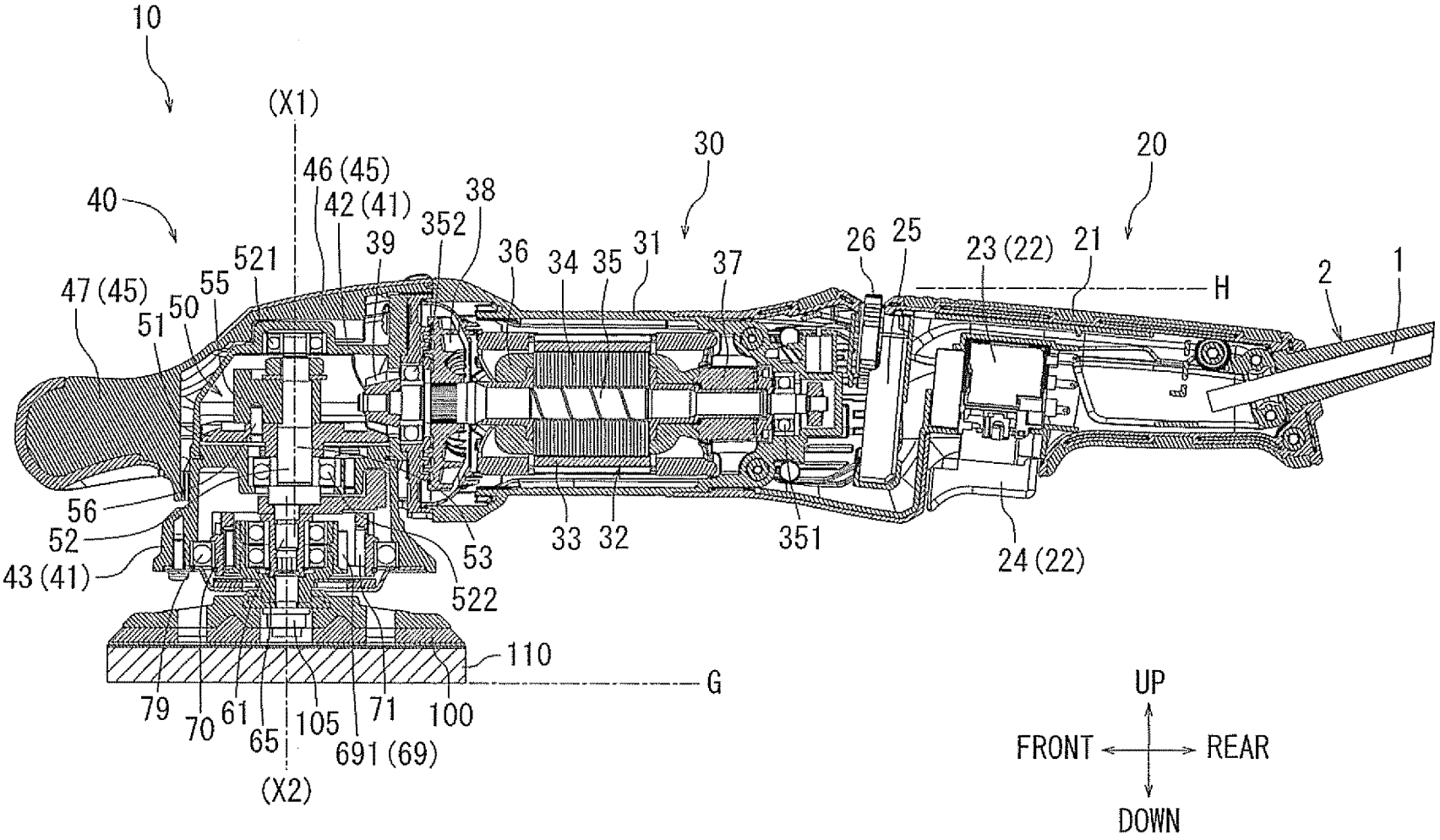
FIG. 2 is a cross sectional view taken along line (II)-(II) in FIG. 1 showing a vertical sectional view along a longitudinal axis of the polisher.

As shown in FIGS. 1 and 2, a power cord 1 may be drawn into the rear portion of the handle housing 21 and may have a connector (not shown) for connection with a commercial AC power source, such as AC 100 V power source, so that the motor 32 can receive a supply of an electric power via the power cord 1. A controller 25 may be disposed within the front portion of the handle housing 21. The controller 25 may electrically connect the power cord 1 to the motor 32 and may control the supply of the electric power to the motor 32. The switch main body 23 and an adjusting dial 26 that will be explained later may be electrically connected to the controller 25, so that the controller 25 may control the motor 32 based on input signals from the switch main body 23 and the adjusting dial 26. The adjusting dial 26 may serve as an input device for inputting a set value for the rotational speed of the motor 32, and more specifically, the revolutions per minute (RPM) of the polishing pad 100.

The motor portion 30 may be connected to the front portion of the handle 20 so as to be disposed on the front side thereof. The motor portion 30 may include a substantially cylindrical motor housing 31. The motor 32 may be disposed within the motor housing 31. The motor 32 may be a brush-less motor and may have a stator 33 and a rotor 34. The stator 33 may be fixedly attached to the motor housing 31. The rotor 34 may be attached to a motor shaft 35 that is rotatably supported by the motor housing 31 via a rear bearing 351 and a front bearing 352.

The rotor 34 may include a rotor coil 36 and a commutator 37 through which the electric power may be supplied from the controller 25 to the rotor coil 36. A cooling fan 38 may be attached to the front portion of the motor shaft 35 and may rotate together with the motor shaft 35. The rotating cooling fan 38 may produce a stream of air that flows toward the cooling fan 38 from its rear side in an axial direction and thereafter flows in a centrifugal direction of the cooling fan 38. The air flowing in the centrifugal direction may be discharged to the outside via discharge holes 28 formed in the rear portion of the output gear portion 40 (see FIG. 1). As shown in FIGS. 2 and 7, a first bevel gear 39 may be attached to the front end portion of the motor shaft 35. The first bevel gear 39 may serve as a rotational force input device for inputting the rotational force to a gear unit 50 that will be explained later.

The output gear portion 40 may include a gear housing 41 that may be made of metal. The gear unit 50 may be disposed within the gear housing 41. The gear housing 41 may include an upper housing portion 42 and a lower housing portion 43 that are joined together by a suitable joint device such as screws (not shown). The outer circumference of the gear housing 41 may be covered with a cover member 45 that may be a resin-molded member. The cover member 45 may include an upper cover portion 46 and a front cover portion 47. The upper cover portion 46 may cover the upper portion of the gear housing 41. The front cover portion 47 may cover the front portion of the gear housing 41. The front cover portion 47 may protrude forward from the gear housing 41 and may serve as a sub-handle that can be grasped by the hand of the user. More specifically, during the polishing operation, the user may apply a pressing force to the polisher 10 via the sub-handle for pressing the polishing pad 100 against the target surfaces.

The rotation of the first bevel gear 39 attached to the front end of the motor shaft 35 may be transmitted to the output member 65 via the gear unit 50. The mode selection device 80 used for selection between the forced rotation mode and the free rotation mode may be directly or indirectly mounted to the gear housing 41.

The gear unit 50 may generally include a second bevel gear 51, a driven shaft member 52 and an internal gear member 70 that are disposed within the gear housing 41. The second bevel gear 51 may engage the first bevel gear 39. The driven shaft member 52 may include a support shaft portion 53 and an eccentric shaft portion 61 that is connected to or integrated with the support shaft portion 53. As shown in FIG. 7, the support shaft portion 53 may have the axis X1, while the eccentric shaft portion 61 may have the axis X2 that is offset or displaced from the axis X1 in the front-rear direction. The second bevel gear 51 may be attached to and supported by the support shaft portion 53, so that the second bevel gear 51 may rotate with the support shaft portion 53 about the axis X1.

The upper housing portion 42 of the gear housing 41 may rotatably support the upper end of the support shaft portion 53 via an upper bearing 521. The lower housing portion 43 of the gear housing 41 may rotatably support the lower end of the support shaft portion 53 via a lower bearing 522. Each of the upper and lower bearings 521 and 522 may be a ball bearing. An upper counterweight 55 may be fitted on the support shaft portion 53 for rotation therewith. More specifically, the counterweight 55 may be joined to the second bevel gear 51 via a plurality of pins 56 each having an upper portion inserted into the counterweight 55 and a lower portion inserted into the second bevel gear 51. Therefore, the counterweight 55 may rotate together with the second bevel gear 51 and eventually, together with the support shaft portion 53.

The support shaft portion 53 may include a diameter-enlarged portion 54 positioned on the lower side of the lower bearing 522. The diameter-enlarge portion 54 may have an outer diameter larger than that of the support shaft portion 53. The eccentric shaft portion 61 may extend downward from the diameter-enlarged portion 54. As described previously, the eccentric shaft portion 61 has the axis X2 that is offset or displaced from the axis X1 of the support shaft portion 53, so that the eccentric shaft portion 61 makes a revolution (an eccentric motion) about the axis X1. The output member 65 may be mounted to the eccentric shaft portion 61 and may make a revolution (an eccentric motion) together with the eccentric shaft portion 61.

A lower counterweight 57 may be mounted to the diameter-enlarged portion 54 and the eccentric shaft portion 61 in a manner astride between both portions in the axial direction, so that the lower counterweight 57 rotates together with the diameter-enlarged portion 54 and the eccentric shaft portion 61 about the axis X1. The lower counterweight 57 may cooperate with the upper counterweight 55 for balancing the eccentric motion of the output member 65. Two bearings 631 and 632 may be interposed between the outer periphery of the eccentric shaft portion 61 and the inner periphery of the output member 65 so as to be arranged side-by-side in the axial direction. More specifically, each of the bearings 631 and 632 may have an inner race 641, an outer race 642 and a plurality of bearing balls 643 interposed between the inner race 64 and the outer race 642. The inner races 641 of the bearings 631 and 632 may be fixedly attached to the outer periphery of the eccentric shaft portion 61 via a first fixing member 62. The outer races 642 of the bearings 631 and 632 may be fixedly attached to the inner periphery of the output member 65 via a second fixing member 651. Therefore, the output member 65 can rotate about the axis X2 relative to the eccentric shaft portion 61 via the bearings 631 and 632.

The output member 65 may have an upper tubular portion and a lower tubular portion that are integrally formed in series with each other. The upper tubular portion may have a diameter larger than that of the lower tubular portion and may constitute the first fixing member 651. The lower tubular portion may constitute a mount portion 652 to which the polishing pad 100 can be detachably attached. More specifically, a female thread may be formed on the inner circumferential surface of the mount portion 652 for engagement with the male screw 105. The polishing pad 100 may have a mount flange 101 for attachment to the mount portion 652. For attaching the polishing pad 100 to the output member 65, the male screw 105 may be tightened into the female screw of the mount portion 652 while the mount flange 101 being positioned between the head portion of the male screw 105 and the lower end surface of the mount portion 652. Thus, the mount flange 101 may be clamped between the head portion of the male screw 105 and the lower end surface of the mount portion 652. With the polishing pad 100 attached to the output member 65 in this way, the polishing pad 100 may be fixed in position relative to the output member 65.

An annular plate 672 may be fixedly attached to the lower portion of the output member 65, more specifically, to a downwardly facing surface of a stepped portion formed between the upper tubular portion and the lower tubular portion of the output member 65. Therefore, the annular plate 672 may move (revolve and rotate) together with the output member 65. A support plate 671 serving as a dust cover may be fixedly attached to the lower end of the lower housing portion 43 via screws 68. The support plate 671 may have a central support portion positioned on the lower side of the annular plate 672 and spaced vertically therefrom by a given distance. The central support portion of the support plate 671 may have a central opening through which the lower tubular portion of the output member 65 extends downward. An annular dust seal 66 may be interposed between the lower surface of the annular plate 672 and the upper surface of the central support portion of the support plate 671. The dust seal 66 may be fixedly attached to the upper surface of the central support portion of the support plate 671, so that the annular plate 672 may slidably contacts the upper surface of the dust seal 66. More specifically, throughout the movement of the annular plate 672, the entire circumference of the lower surface of the annular plate 672 may be in slide-contact with the upper surface of the dust seal 66. Therefore, it may be possible to prevent dust and/or water from entering into the internal space of the gear housing 41 during the polishing operation. The dust seal 66 may have a two-layer structure including an upper layer and a lower layer. The lower layer may be adhered to the upper surface of the support plate 671 and may be formed of a sponge material. The upper layer may be attached to the upper surface of the lower layer and may be formed of a sheet material of high slidability.

A substantially cylindrical gear member 69 may be fixedly fitted on the upper tubular portion of the output member 65 so as to be rotatable together with the output member 65 about the axis X2. An external gear 691 that may be a spur gear may be formed on the outer circumferential surface of the gear member 69. The external gear 691 may engage an internal gear 71 of the internal gear member 70 that will be described later.

The internal gear member 70 may be disposed on the radially outer side of the external gear member 69. Similar to the external gear 691, the internal gear 71 may be a spur gear and may be formed on the inner circumferential surface of the internal gear member 70 along a path of revolution of the output member 65 for engagement with the external gear 691 of the gear member 69. The lower housing portion 43 of the gear housing 41 may support the internal gear member 70 via a bearing 79, so that the internal gear member 70 can rotate relative to the gear housing 41 about an axis that may coincide with the axis X1 of the support shaft portion 53.

Figure 9:
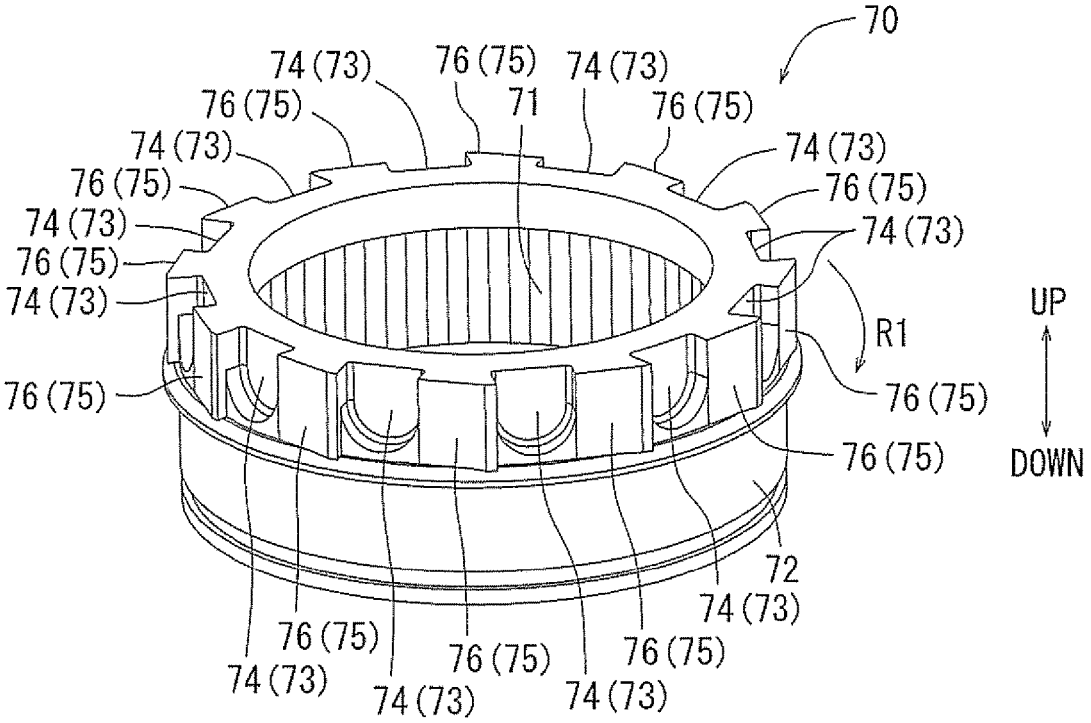
FIG. 9 is a perspective view of an internal gear member of the polisher.

As shown in FIG. 9, the internal gear member 70 may have a substantially ring shape. The outer circumferential surface of the internal gear member 70 may include an upper half portion and a lower half portion that are configured differently from each other. More specifically, the lower half portion may be configured as a support circumferential surface 72 that may be a smooth surface fitted with the inner circumferential surface of the bearing 79.

On the other hand, the upper half portion of the outer circumferential surface of the internal gear member 70 may be configured as a pin engaging portion 73. The pin engaging portion 73 may include a plurality of engaging grooves 74 spaced equally from each other in the circumferential direction. In this embodiment, twelve engaging grooves 74 are provided. As will be explained later, an engaging pin 81 of the mode selection device 80 may be movable in a radial direction of the internal gear member 70 for engaging with any one of the engaging grooves 74 and for disengagement therefrom. When the engaging pin 81 engages any one of the engaging grooves 74, the internal gear member 70 may be fixed in position relative to the gear housing 41 in the circumferential direction. When the engaging pin 81 disengages from the engaging grooves 74, the internal gear member 70 may be free to rotate relative to the gear housing 41.

Separating portions 75 may be each formed between two engaging grooves 74 arranged adjacent to each other in the circumferential direction. Each of the separating portions 75 may have a shape of a projection that projects radially outward with respect to the two engaging grooves 74 disposed on its opposite sides. The radially outer surface of each separating portion 75 may be configured as an engagement prohibiting surface 76. The engagement inhibiting surface 76 may be inclined radially outward in a reverse rotational direction that is opposite to a normal rotational direction R1 of the internal gear member 70.

As will be explained later, the engagement prohibiting surfaces 76 may serve to prohibit engagement of the engaging pin 81 with the engaging grooves 74 when the rotational speed of the internal gear member 70 exceeds a predetermined speed.

Figure 10:
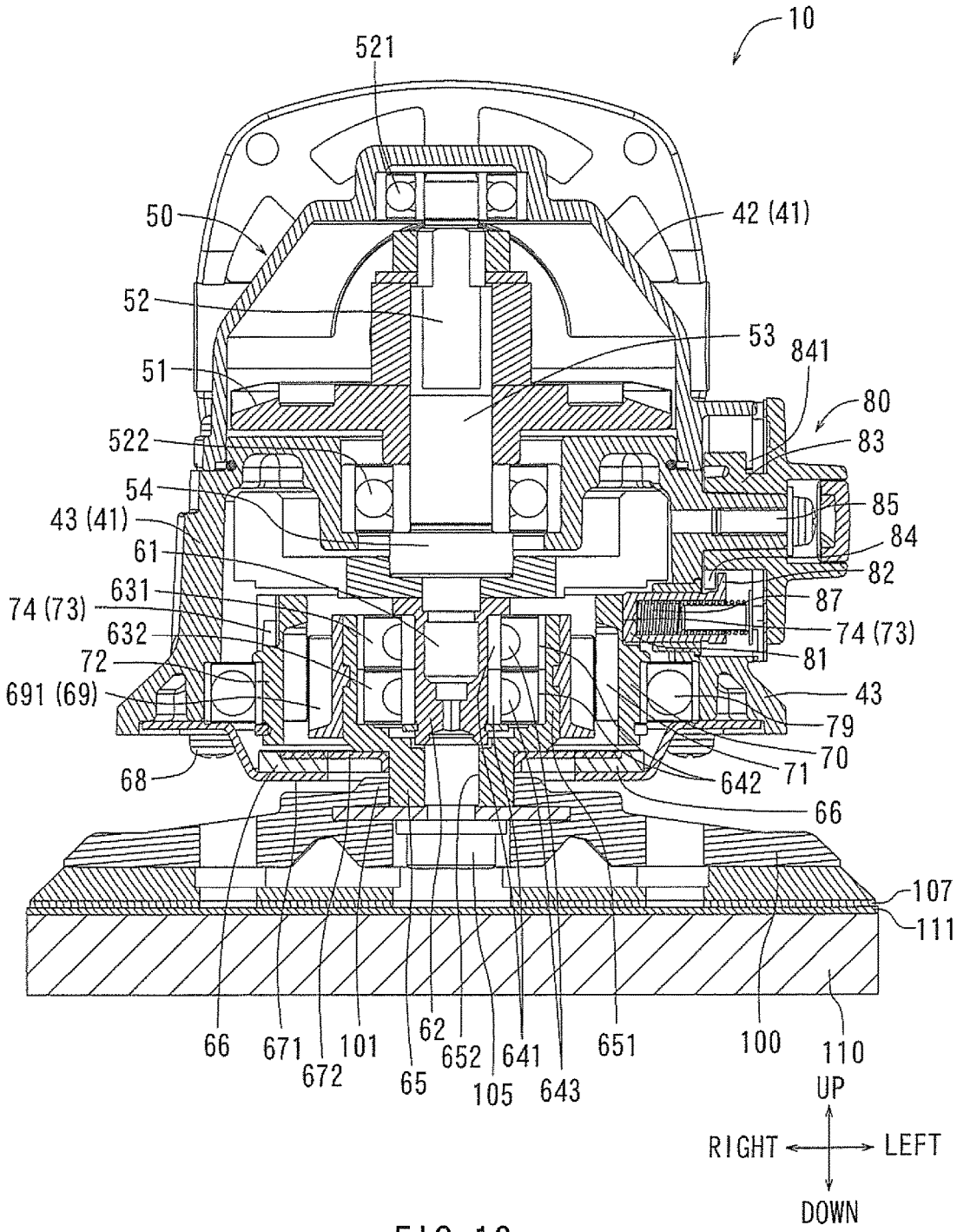
FIG. 10 is a view similar to FIG. 8 but showing the internal gear member fixed in position in the rotational direction.

As described above, the mode selection device 80 may include the engaging pin 81. In addition, as shown in FIGS. 7, 9 and 10, the mode selection device 80 may further include a switch knob 83 and a biasing spring 87. The engaging pin 81 may be inserted into an insertion hole formed in the lower housing portion of the gear housing 41 in the radial direction such that its head portion (the right end portion as shown according to the legend in FIG. 8) protrudes into the internal space of the gear housing 41. The head portion of the engaging pin 81 may be configured to correspond to the grooved shape of the engaging grooves 74. The engaging pin 81 may have an axial hole with a right closed end and a left open end for receiving the biasing spring 87. A flange 82 may be formed on the end portion (the left end portion as shown in according to the legend in FIG. 8) opposite to the head portion. The flange 82 may serve to limit the stroke end of the engaging pin 81 in an engaging direction (i.e., the radial direction) toward the engaging grooves 74. A guide shaft 88 may be inserted into the axial hole of the engaging pin 81. The biasing spring 87 may be fitted over the guide shaft 88 so as to be arranged between the outer circumferential surface of the guide shat 88 and the inner circumferential surface of the axial hole of the engaging pin 81. The biasing spring 87 may have opposite ends contacting the closed end of the axial hole of the engaging pin 81 and a flanged left end of the guide shaft 88, respectively. The guide shaft 88 may serve to support the biasing spring 87 such that the biasing spring 87 is held to extend in the axial direction of the guide shaft 88 (i.e., the radial direction of the internal gear member 70) during the movement of the engaging pin 81. In this way, the biasing force of the biasing spring 87 can be adequately applied to the engaging pin 81 in the axial direction of the guide shaft 88, so that the engaging pin 81 may be biased in the radial direction toward the internal gear member 70. The flanged left end of the guide shaft 88 may slidably contact a radially outwardly flanged portion of the switching knob 83 by the biasing force of the biasing spring 87.

Figure 8:
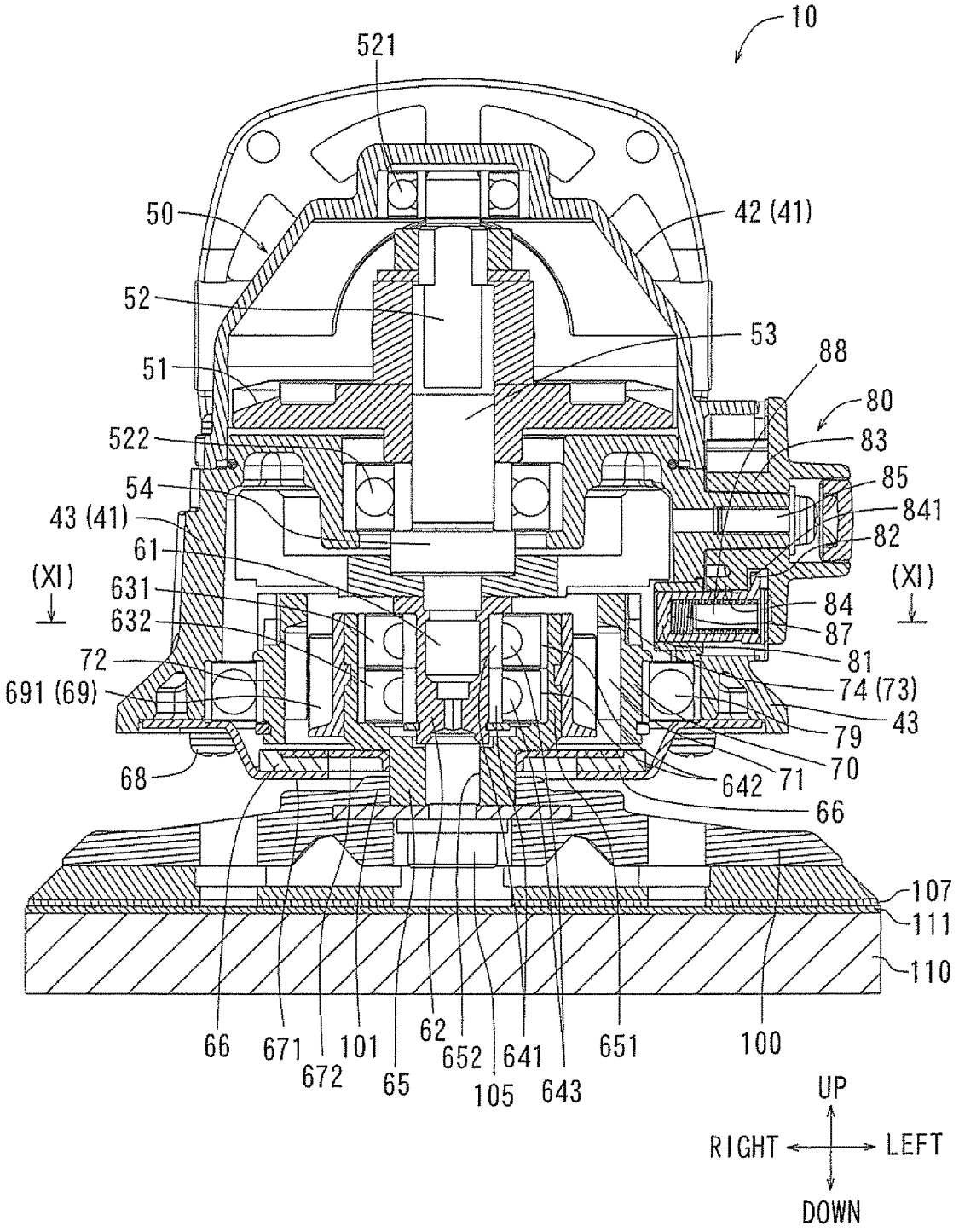
FIG. 8 is an enlarged cross sectional view taken along line (VIII)-(VIII) in FIG. 1.

The switching knob 83 may be mounted to the left side outer surface of the lower hosing portion 43 of the gear housing 41 via a screw 85 such that the knob can rotate about an axis of the screw 85 which lies parallel to the movement axis of the engaging pin 81 and the right-left axis, per the legend as shown in FIG. 8. In this way, the switching knob 83 may be configured as a rotary dial. The switching knob 83 may have a guide portion 84 formed on its inner side (right side). The guide portion 84 may define a cam surface 841 which may be contacted by the upper flange portion 82 of the engaging pin 81 due to the biasing force of the biasing spring 87. The cam surface 841 may be configured such that its position in the left-to-right direction changes in the rotational direction of the switching knob 83, so that the position in the left-to-right direction of the engaging pin 81 contacting the cam surface 841 may vary with a change of the rotational position of the cam surface 841. As the switching knob 83 rotates in a clockwise direction, for example, from its counterclockwise limit position, to reach its clockwise limit position, the engaging pin 81 may move against the biasing force of the biasing spring 87 to reach a left limit position as shown in FIG. 8. In other words, the anti-biasing force amount applied to the engaging pin 81 in the left direction given by the cam surface 841 of the guide portion 84 may reach a maximum in this manner. The engaging pin 81 thus positioned at the left limit position may be away from the internal gear member 70 and may not interact with the engaging grooves 74 or the engagement prohibiting surfaces 76 of the internal gear member 70.

On the other hand, as the switching knob 83 rotates in a counterclockwise direction, for example, from its clockwise limit, to reach its counterclockwise limit position, the anti-biasing force amount applied to the engaging pin 81 in the left direction given by the cam surface 841 of the guide portion 84 reaches a minimum, such that the biasing force of the biasing spring 87 is inhibited to a lesser degree, enabling the head portion of the engaging pin 81 to protrude into the internal space of the gear housing 41 at a right limit position as shown in FIG. 10. The engaging pin 81 thus positioned at the right limit position may engage any one of the engaging grooves 74 or may contact any one of the engagement prohibiting surfaces 76. The engaging pin 81 having contacted with any one of the engagement prohibiting surfaces 76 may be brought to engage the adjacent engaging groove 74 as the internal gear member 70 rotates as will be explained later.

When the engaging pin 81 engages any one of the engaging grooves 74 of the internal gear 70 as shown in FIG. 10, the internal gear member 71 may be fixed in position relative to the gear housing 41 with respect to rotation. In this state, the gear member 69 is forced to rotate relative to the internal gear member 70 through engagement between the external gear 691 and the internal gear 71, so that the output member 65 may rotate together with the gear member 69 and also together with the polishing pad 100 about the axis X2 while the output member 65 revolves about the axis X1 together with the gear member 69 and the polishing pad 100. In this way, the polishing pad 100 may be forced to rotate about the axis X2 while it revolves about the axis X1. This mode will be hereinafter called a "forced rotation mode."

On the other hand, when the engaging pin 81 does not engage any of the engaging grooves 74 of the internal gear 70 and is at the left limit position as shown in FIG. 8, the internal gear member 71 may be free to rotate relative to the gear housing 41. In this state, the polishing pad 100 may be free to rotate about the axis X2 while it revolves about the axis X1. More specifically, depending on the load applied to the polishing pad 100 during the polishing operation, the polishing pad 100 may rotate about the axis X2 at a speed equal to or lower than the revolution speed (around axis X1) of the polishing pad 100 or may not rotate about the axis X2. This mode will be hereinafter called a "free rotation mode."

If the user wishes to change the operation mode from the free rotation mode to the forced rotation mode, the user may rotate the switching knob 83 in the clockwise direction to move the engaging pin 81 to the right limit position for engagement with any one of the engaging grooves 74 of the internal gear member 70. However, it may be possible that the internal gear member 70 is already rotating at the time of change of the operation mode. This scenario poses the risk of the engaging pin 81 abruptly engaging any one of the engaging grooves 74 of the rotating internal gear member 70, which would cause damage to the engaging pin 81 and/or the engaging grooves 74. For this reason, in the present embodiment, the internal gear member 70 may be provided with the engagement prohibiting surfaces 76 that can prohibit abrupt engagement of the engaging pin 81 with the engaging grooves 74 when the internal gear member 70 rotates at a speed higher than a predetermined speed.

Figure 11:
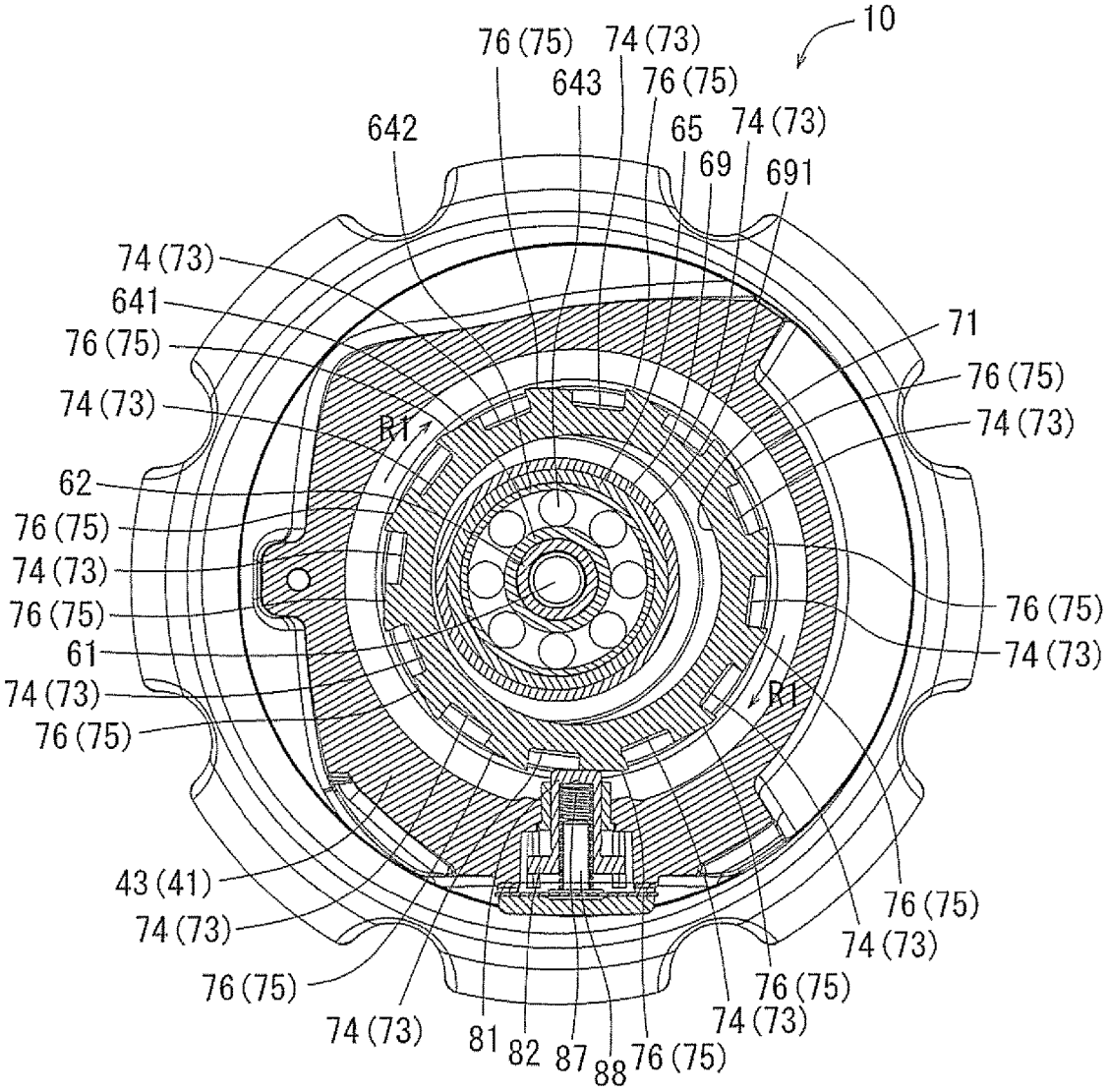
FIG. 11 is a sectional view taken along line (XI)-(XI) in FIG. 8 showing the state where an engaging pin contacts one of engagement prohibiting surfaces of the internal gear member.
Figure 12:
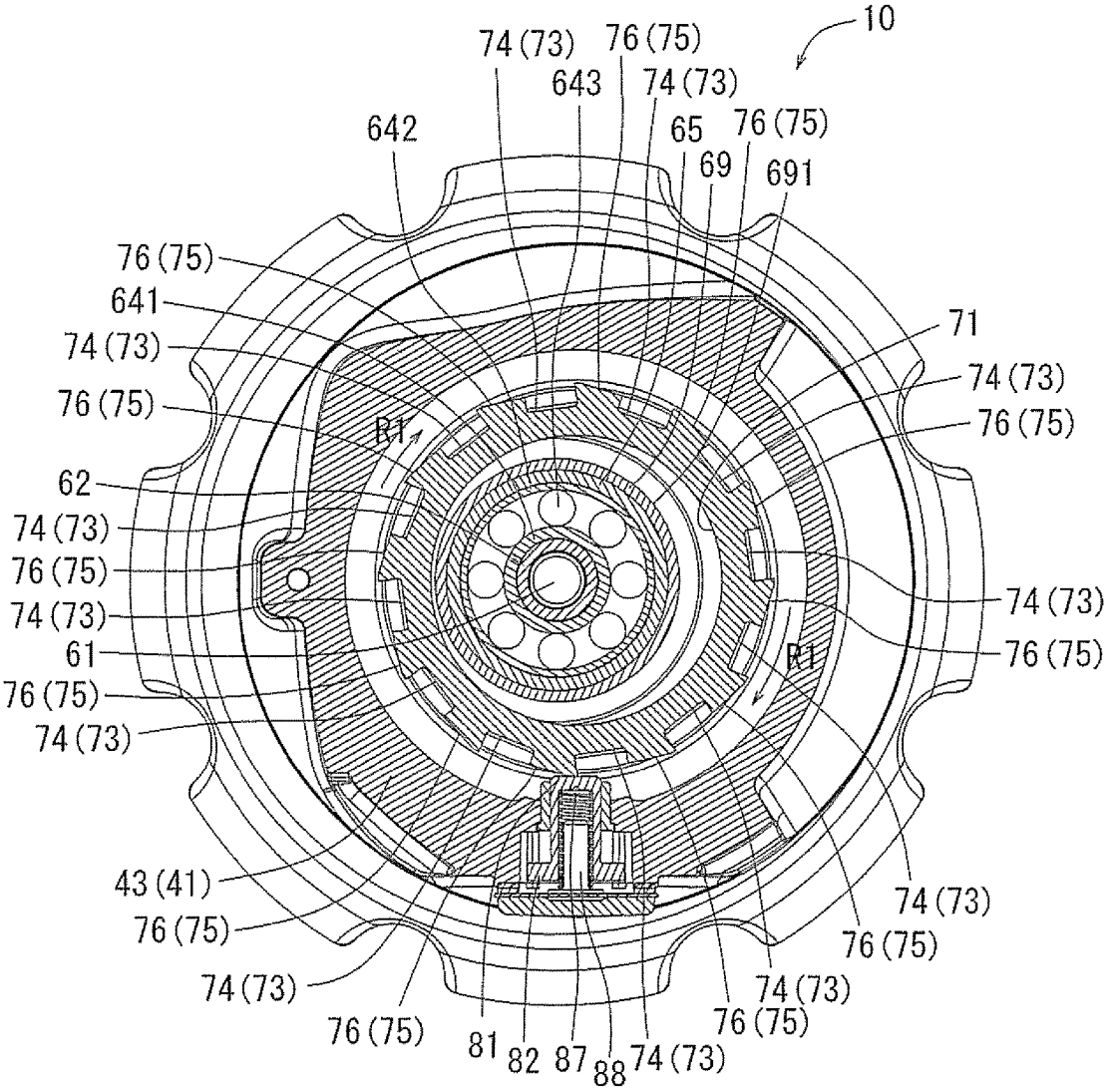
FIG. 12 is a perspective view similar to FIG. 11 but showing the state where the engaging pin has moved radially outward along the one of engagement prohibiting surfaces.

As described previously, the engagement prohibiting surfaces 76 may be inclined radially outward in a reverse rotational direction that is opposite to the normal rotational direction R1 of the internal gear member 70. Therefore, as the engaging pin 81 moves radially toward the rotating internal gear member 70, the engaging pin 81 may first contact one of the engagement prohibiting surfaces 76 as shown in FIG. 11. As the internal gear member 70 further rotates, due to the radially outward force provided by the movement of surface 76, against pin 81 and the radially inward biasing force of the biasing spring 87, the engaging pin 81 may be forced to move radially outward as shown in FIG. 12 such that it may traverse the engagement prohibiting surface 76 first contacted. Thereafter, the engaging pin 81 may contact the engagement prohibiting surface 76 positioned next to the previous one, in the rotational direction, and may consequently traverse that surface 76 as well. This action of the engaging pin 81 traversing the engagement prohibiting surfaces 76 may continue to occur until the rotational speed of the internal gear member 70 is lower than the predetermined speed, where the rotational speed of the internal gear member 70 is reduced to the extent that the radially outward centrifugal force applied to the engaging pin 81 by any of the engagement prohibiting surfaces 76 (hereinafter called "the last engagement prohibiting surface 76") becomes smaller than the biasing force of the biasing spring 87). After the engaging pin 81 has contacted the last engagement prohibiting surface 76, the internal gear member 70 may rotate in the opposite rotational direction by a small distance due to the biasing force applied by the engaging pin 81, such that the engaging pin 81 may move along the last engagement prohibiting surface 76 so as to be brought to engage the engaging groove 74 positioned adjacent to the last engagement prohibiting surface 76 in the opposite rotational direction relative to the initial rotation of the internal gear member. In this way, the engagement prohibiting surfaces 76 may act in a multi-purpose manner, serving not only as a brake device for stopping the rotation of the internal gear member 70 but also as a guide device for guiding the engaging pin 18 for engagement with the engaging grooves 74.

As described previously, the handle housing 21 of the handle 20 may include the right and left housing halves 21R and 21L that are joined together, and the power cord 1 may be drawn into the rear portion of the handle housing 21. More specifically, a holding sleeve 2 may be attached to the rear portion of the housing 21. The power cord 1 may be inserted into the holding sleeve 2, so that the power cord 1 may extend from the inside to the outside of the handle housing 21 under the guide of the holding sleeve 2. In this way, the holding sleeve 2 may serve as a support device or a guide device for the power cord 1 as well as serving as a holding device. In this embodiment, the holding sleeve 2 may be made of a resilient material, such as rubber, to allow resilient deformation or bending of the holding device 2, while the original shape (substantially straight shape in this embodiment) of the holding device 2 may be normally kept when no load is applied to the holding sleeve 2 except for a load normally applied by the weight of the power cord 1. Therefore, due to the guiding and support functions of holding sleeve 2, it may be possible to prevent wires of the power cord 1 from being broken as a result of abruptly bending at a portion that is drawn from within the handle housing 21, The extending direction of the power cord 1 through the holding sleeve 2 may coincide with the extending direction of the holding sleeve 2. Therefore, the extending direction of the power cord 1 may change with a change of the extending direction of the holding sleeve 2, which may be caused within a resiliently deformable range of the holding sleeve 2, for example, by applying an external force to the holding sleeve 2.

Figure 3:
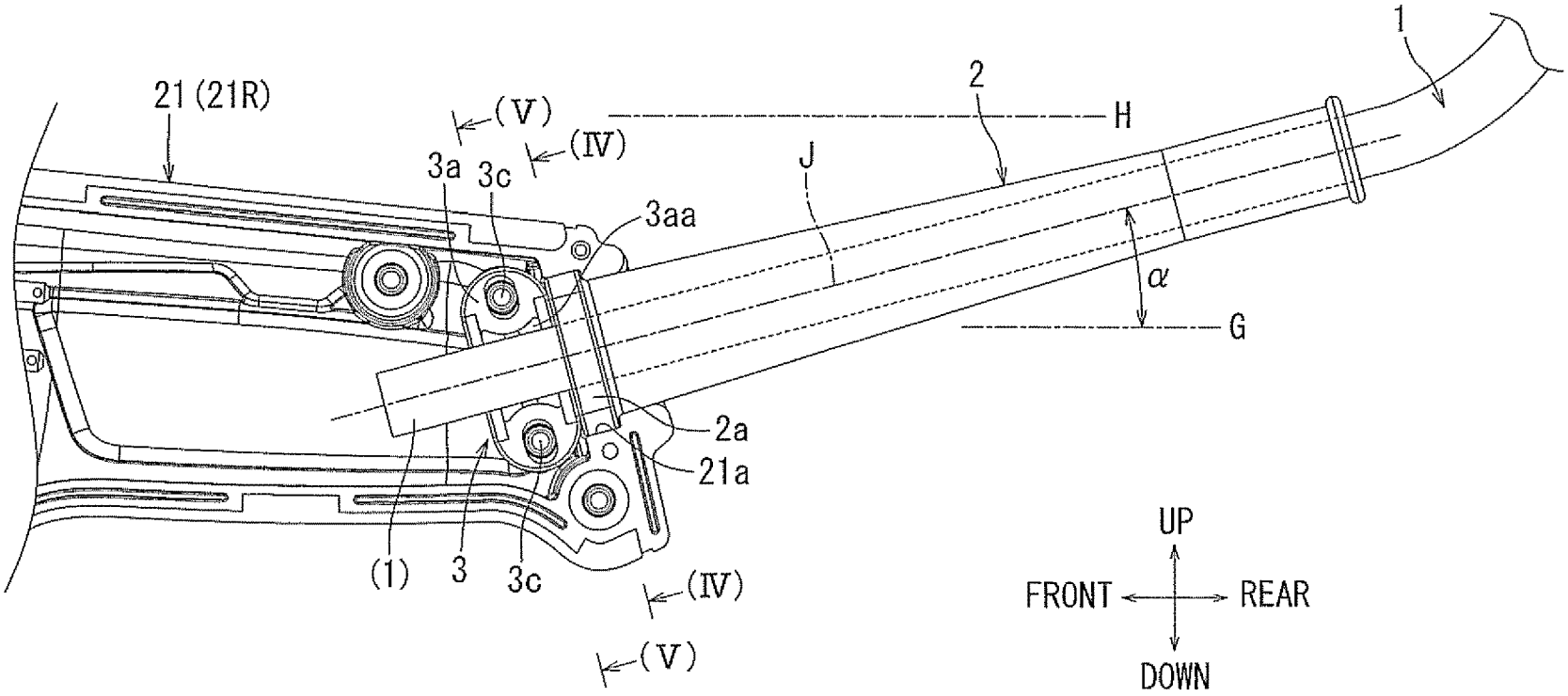
FIG. 3 is an enlarged vertical sectional view of a rear portion of a handle of the polisher, from which a power cord extends.

As shown in FIGS. 2 and 3, the extending direction of the power cord 1 from within the handle housing 21 may be inclined upward with respect to a polishing surface of the polishing pad 100, which may contact a target surface G (i.e., a surface of an article, a machine or an equipment to be polished). In this embodiment, the polishing surface is the lower surface of the polishing sponge 110. As long as the holding sleeve 2 maintains its original shape, for example, when no external force is applied to the holding sleeve 2, the holding sleeve 2 may be inclined upward in the rear direction in the state of being attached to the handle housing 21. More specifically, the holding sleeve 2 may be attached to the handle housing 21 in such a state that its longitudinal axis J is inclined upward by an angle $\alpha$ relative to the polishing surface (or the target surface G). Therefore, the extending direction of the power cord 1 may be also inclined upward by the angle $\alpha$ relative to the polishing surface. The angle $\alpha$ may be set, for example, to about 15 degrees.

Figure 4:
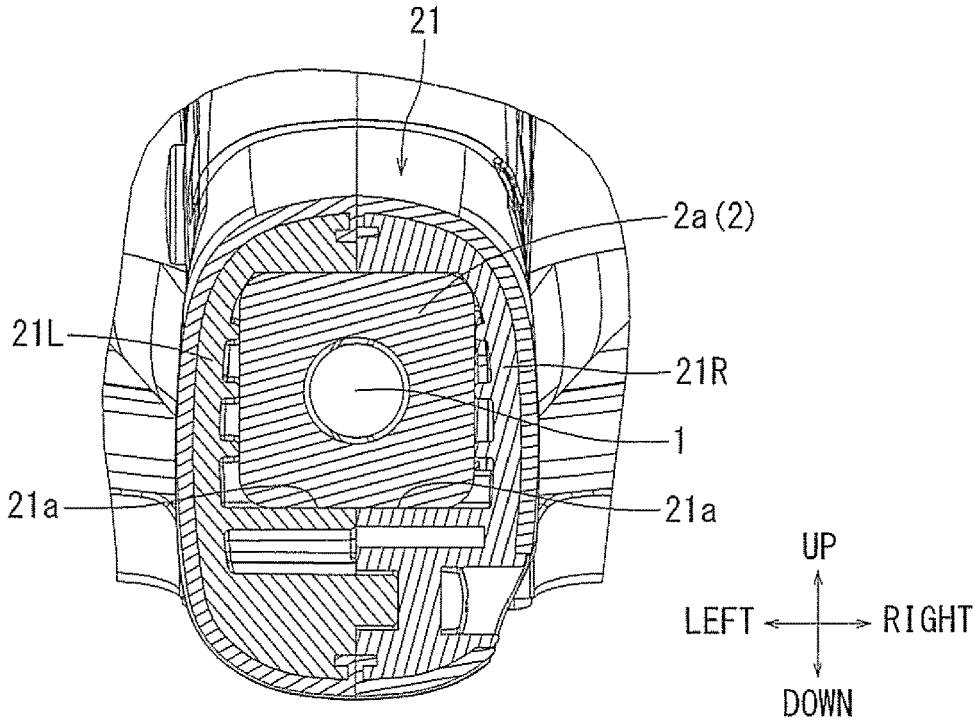
FIG. 4 is a cross sectional view taken along line (IV)-(IV) in FIG. 3 showing a cross sectional view of the power cord.

A flange 2*a* may be formed at the front end of the holding sleeve 2 and may have a substantially rectangular shape as viewed in the front-rear direction along the longitudinal axis J as shown in FIG. 4. An engaging groove 21*a* having a substantially rectangular shape complementary to the shape of the flange 2*a* may be formed in the rear end of the handle housing 21. More specifically, the engaging groove 21*a* may include a left part formed in the left housing half 21L and a right part formed in the right housing half 21R. The left part and the right part may jointly form the engaging groove 21*a* when the left housing half 21L and the right housing half 21R are joined together. Therefore, the flange 2*a* may be engaged with the engaging groove 21*a* when the left housing half 21L and the right housing half 21R are joined together with the flange 2*a* positioned between the left part and the right part of the engaging groove 21*a*. With the flange 2*a* engaged with the engaging groove 21*a* of the rear end of the handle housing 21, the holding sleeve 2 may be prevented from moving relative to the handle housing 21 in the direction of the longitudinal axis J and may be also prevented from rotating about the longitudinal axis J.

Figure 5:
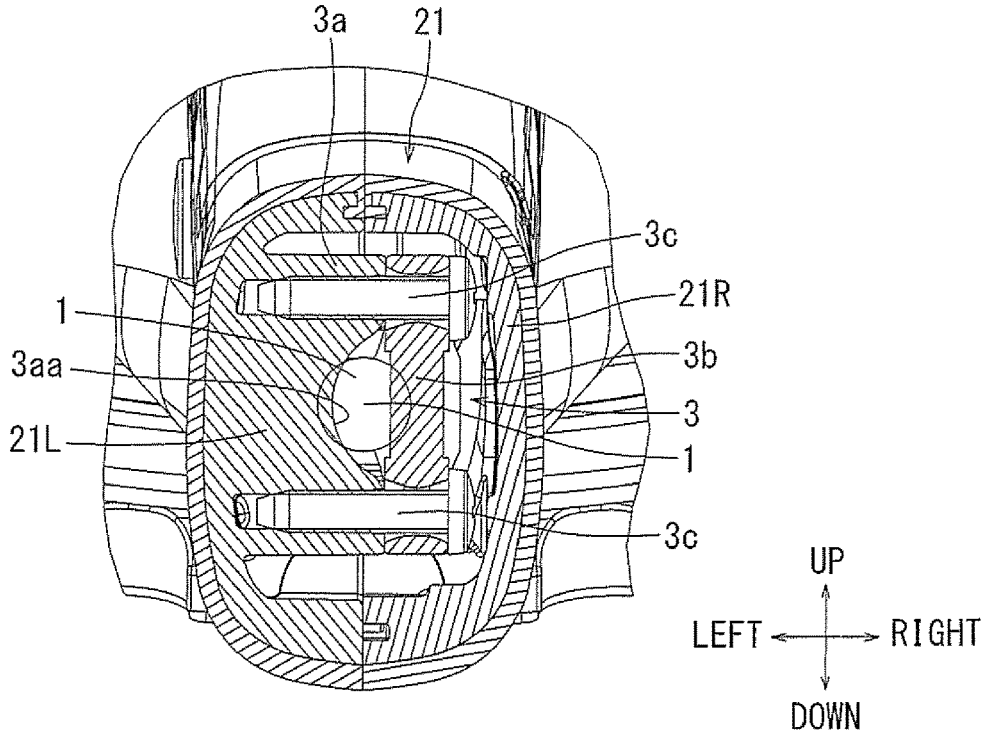
FIG. 5 is a cross sectional view taken along line (V)-(V) in FIG. 3 showing a cross sectional view of a fixing device of the power cord.

Referring to FIGS. 3 and 5, a cord fixing device 3 may be disposed within the rear portion of the handle housing 21 at a position on the front side of the engaging groove 21*a*. The cord fixing device 3 may serve to fix a part of the power cord 1 that extends forward from the front end having the flange 2*a* of the holding sleeve 2. The cord fixing device 3 may include a receiving member 3*a* and a fixing member 3*b*. The receiving member 3*a* may be fixedly attached to or integrated with the inner surface of the left housing half 21L. A recess 3*aa* having a semicircular shape may be formed in the right side surface of the receiving member 3*a*. The fixing member 3*b* may have a shape of a substantially flat plate and may be fixedly attached to the receiving member 3*a* with a part of the power cord 1 positioned between the receiving member 3*a* and the fixing member 3*b*. In particular, power cord 1 may be engaged by the recess 3*aa* of the receiving member 3*a* and the right side surface of the fixing member 3*b* from opposite sides (i.e., the left and right sides), fixedly clamping the power cord. Preferably, in constructing the housing, the operation for fixing the power cord 1 by the cord fixing device 3 may be performed before the left housing portion 21L and the right housing portion 21R are joined together. Thus, after the power cord 1 has been fixed by the cord fixing device 3, the left housing portion 21L and the right housing portion 21R may be joined together, and at the same time, the flange 2*a* of the holding sleeve 2 may be engaged with the engaging groove 21*a*.

In the polisher 10 according to the first embodiment described above, the gear unit 50 is designed such that the rotational drive force is transmitted to the output member 65 to enable two different modes with respect to the rotational output of the polishing pad 100 (i.e., the forced rotation mode and the free rotation mode). In addition, for changing or selecting the output mode, the mode selection device 80 including the engaging pin 81 may be disposed in the gear housing 41, which also supports the gear unit 50. Therefore, the user can select the output mode from two different modes by operating the mode selection device 80. In this way, two different polishing modes can be achieved without needing to change the polishing pad 100.

In addition, in the above embodiment, the internal gear member 70 may be provided with the engagement prohibiting surfaces 76 that can prohibit engagement of the engaging pin 81 with the engaging grooves 74 when the internal gear member 70 rotates at a speed higher than the predetermined speed, as described above. Therefore, it may be possible to prevent potential damage to the engaging pin 81 and/or the engaging grooves 74, which may be caused by abrupt engagement of the engaging pin 81 with the engaging grooves 74. As a result, it may be possible to extend a lifetime of the polisher 10.

Further, the engagement prohibiting surface 76 may be formed between each pair of adjacent engaging grooves 74 and may be configured as an inclined surface inclined radially outward in the direction opposite to the normal rotational direction R1. Therefore, the engagement prohibiting function can occur without need of a separate device apart from the internal gear member 70. Furthermore, the engaging pin 81 may move in the radial inward direction towards the internal gear member 70 for engagement and disengagement with the engaging grooves 74. Therefore, the engaging pin 81 may be disposed on a radially outer side of the internal gear member 70. Hence, the polisher 10 may be designed to be compact in size in the axial direction of the internal gear member 70, i.e., the vertical direction.

Figure 6:
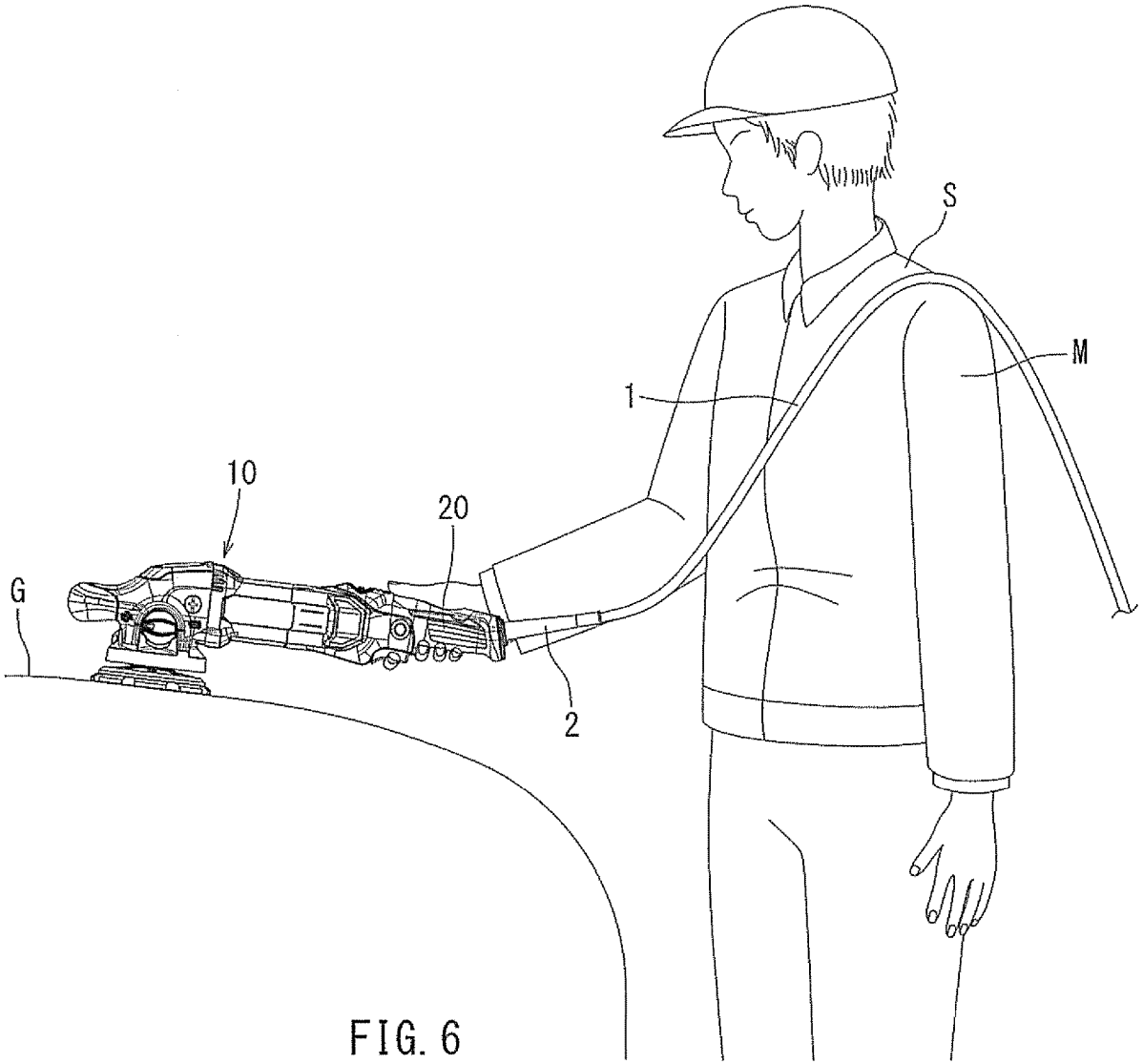
FIG. 6 is a view showing a user who performs a polishing operation of a target surface by using the polisher, while the power cord is hung over a shoulder of the user.

Furthermore, in the polisher 10 of the above embodiment, the power cord 1 may extend from the rear portion of the handle housing 21 (i.e., the rear portion of the handle 20) in a direction inclined upward by the angle α that may be 15 degrees. With this arrangement, it may be possible to inhibit or minimize such an occasion that the power cord 1 accidentally contacts the target surface G to be polished, during the polishing operation. As a result, the polishing operation can be quickly performed to achieve a fine finish of the target surface G without undesired interference by the power cord contacting the target surface. Further, as shown in FIG. 6, it is possible for a user M to perform the polishing operation of the target surface G by the polisher 10 while the power cord 1 of the polisher 10 is hung over his/her shoulder, to prevent the power cord 1 from contacting the target surface G or any other surfaces. In this case, because of the upward inclination of the power cord 1 from the rear portion of the handle 20, it is also possible to prevent a portion of the power cord 1 extending between the rear portion of the handle 20 and the shoulder S of the user M from being abruptly bent or curved, aiding in preventing potential breakage of wires of the power cord 1.

The upward inclination angle α with respect to the polishing surface (or the target surface G) of the extending direction of the power cord 1 from the rear portion of the handle 20, i.e., the extending direction of the holding sleeve 2, may not be limited to 15 degrees. For example, the upward inclination angle α may be set within a range of about 5 to 90 degrees. Preferably, the upward inclination angle α may be set such that the upper end of the holding sleeve 2 is lower than a height H (see FIG. 3) of the polisher 10 with respect to the polishing surface (or the target surface G) and may be, for example, within a range of about 10 to 60 degrees. With this setting of the upward inclination angle α, it may be possible to prevent a potential deformation (bending or curving) of the holding sleeve 2 when the polisher 10 is stored within a limited storage space.

Further, although the upward inclination angle α of the extending direction of the power cord 1 is a fixed value in the above embodiment, it may be possible to configure such that the upward inclination angle α can be adjusted to a desired value. For example, the holding sleeve 2 may be pivotally connected to the rear portion of the handle 20 such that the holding sleeve 2 can be tilted vertically relative to the handle 20. In this case, a fixing device may preferably be provided for fixing the tilt position of the holding sleeve 2. With this arrangement, it may be possible to adjust the upward inclination angle α, for example, depending on a posture to be taken by the user during the polishing operation. As a result, it may be possible to further reliably inhibit or minimize such an occasion that the power cord 1 accidentally contacts the target surface G to be polished, during the polishing operation. Further, it may be possible to further reliably prevent the power cord 1 from being abruptly bent or curved, whereby it may be possible to further reliably prevent potential breakage of wires of the power cord 1.

Second Embodiment

A second embodiment will now be described with reference to FIGS. 13 to 15. The second embodiment is a modification of the first embodiment. Therefore, in FIGS. 13 to 15, like members are given the same reference numerals as the first embodiment, and a description of these members will be omitted. Further, as reference numerals of members that are similar to those of the first embodiment but are somewhat different in construction or shape from them, the reference numerals of the corresponding members of the first embodiment may be used with an alphabet "A" affixed to the last digit of each reference numeral.

A polisher 10A of the second embodiment may be different from the polisher 10 of the first embodiment mainly in the construction of an internal gear member 70A, a mode selection device 80A and their associated structure.

The internal gear member 70A may be different from the internal gear member 70 of the first embodiment in that a pin engaging portion 73A is disposed at a different position from the pin engaging portion 73. More specifically, the pin engaging portion 73A may be disposed at an upper surface 77A, i.e., one of two surfaces of the internal gear member 70A facing opposite to each other. The pin engaging portion 73A may include a plurality of engaging grooves 74A spaced equally from each other in the circumferential direction. Also in this embodiment, twelve engaging grooves 74A are provided. Each of the engaging grooves 74A may have a substantially circular shape for engagement with an engaging pin 81A of the mode selection device 80A.

Separating portions 75A may be each formed between two engaging grooves 74A arranged adjacent to each other in the circumferential direction. Each of the separating portions 75A may have a shape of a projection protruding upward with respect to the two engaging grooves 74A disposed on its opposite sides. The upper surface of each separating portion 75A may be configured as an engagement prohibiting surface 76A. The engagement prohibiting surface 76A may be inclined upward in a reverse rotational direction that is opposite to a normal rotational direction R1 of the internal gear member 70A.

Similar to the engagement prohibiting surfaces 76 of the first embodiment, the engagement prohibiting surfaces 76A may serve to prohibit engagement of the engaging pin 81A with the engaging grooves 74A when the rotational speed of the internal gear member 70A exceeds a predetermined speed. Also in this embodiment, the mode selection device 80A may be directly or indirectly mounted to the gear housing 41A for enabling selection between the forced rotation mode and the free rotation mode.

Figure 13:
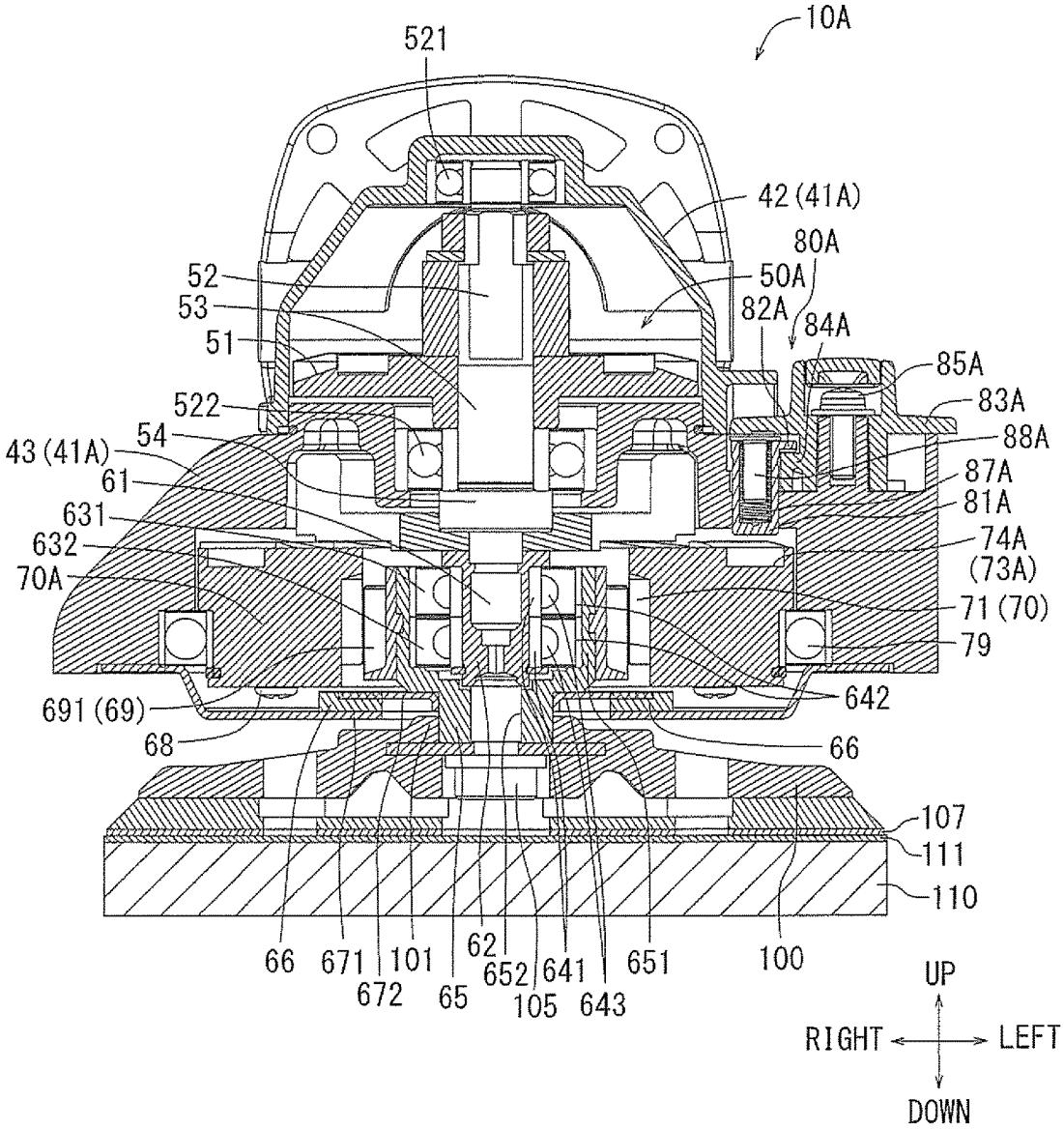
FIG. 13 is a view similar to FIG. 8 but showing a vertical sectional view of a gear unit of a polisher according to a second embodiment.
Figure 14:
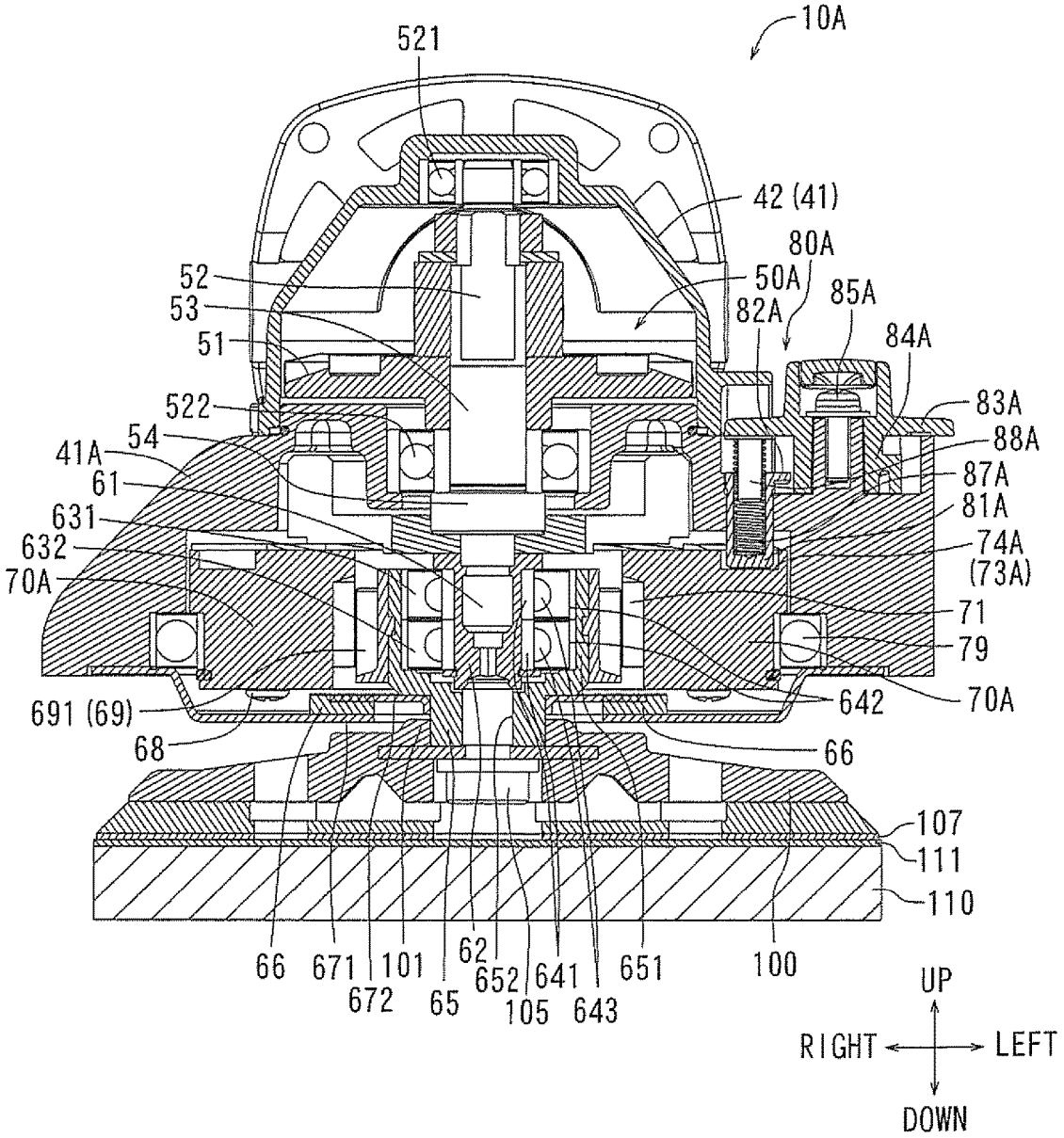
FIG. 14 is a view similar to FIG. 13 but showing the state where an internal gear member is fixed in position in the rotational direction.
Figure 15:
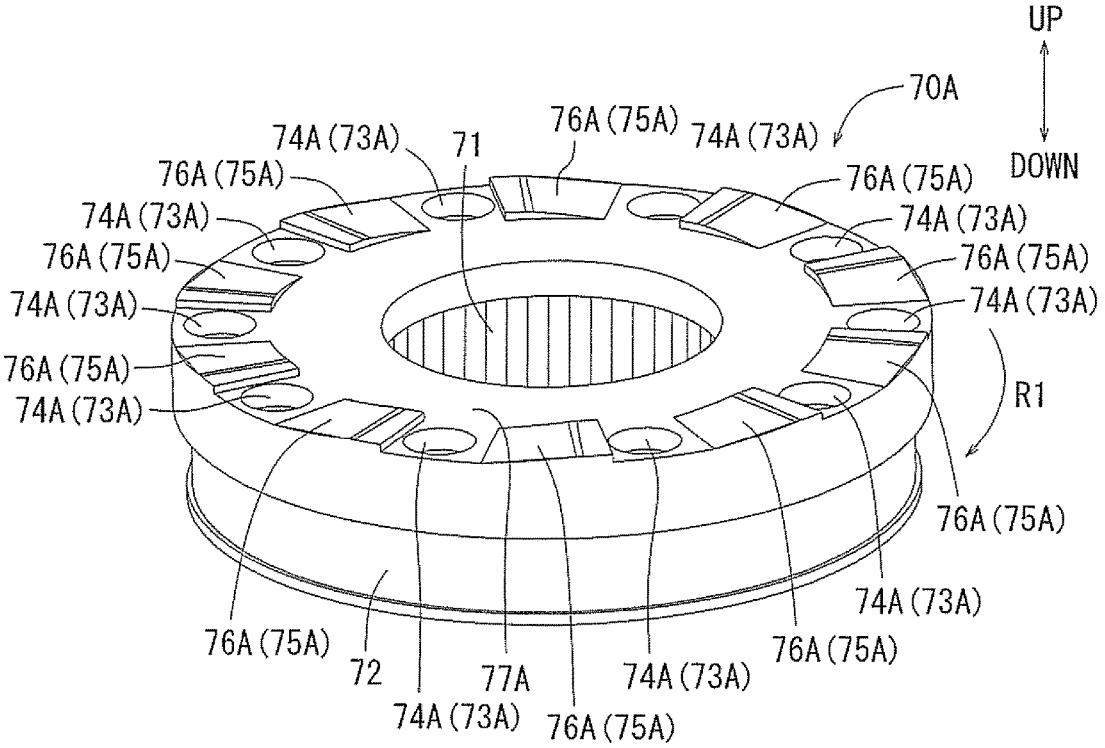
FIG. 15 is a perspective view of the internal gear member of the polisher according to the second embodiment.

Similar to the mode selection device 80 of the first embodiment, the mode selection device 80A may include a switch knob 83A and a biasing spring 87A in addition to the engaging pin 81A as shown in FIGS. 13 and 14. The engaging pin 81A may be inserted into an insertion hole formed in the gear housing 41A in the axial direction (i.e., a direction parallel to the axes X1 and X2) such that its head portion (the lower end portion as viewed in FIGS. 13 and 14)

protrudes into the internal space of the gear housing 41A. The head portion of the engaging pin 81A may be configured to correspond to the grooved shape of the engaging grooves 74A. The engaging pin 81A may have an axial hole with a lower closed end and an upper open end for receiving the biasing spring 87A. A flange 82A may be formed on the upper end portion opposite to the head portion. A guide shaft 88A may be inserted into the axial hole of the engaging pin 81A. The guide shaft 88A may have a flanged upper end that is fixedly attached to the inner wall of the upper part of the lower housing portion 43 of the gear housing 41A, so that the guide shaft 88A protrudes downward toward the internal gear 71A of the internal gear member 70A. The biasing spring 87A may be fitted over the guide shaft 88A and may have opposite ends contacting the closed end of the axial hole and the flanged upper end of the guide shaft 88A, respectively, so that the engaging pin 81 may be biased downward toward the internal gear 71A.

The switching knob 83A may be mounted to the upper surface of the left side portion of the lower hosing portion 43 of the gear housing 41A via a screw 85A such that it can rotate about an axis of the screw 85A which lies parallel to the movement axis of the engaging pin 81A, and the up-down axis. In this way, the switching knob 83A may be configured as a rotary dial. The switching knob 83A may have a guide portion 84A formed on its inner side (lower side). The guide portion 84 may define a cam surface which the flange portion 82A of the engaging pin 81A contacts due to the downwards biasing force of the biasing spring 87A. The cam surface of the guide portion 84A may be configured such that its position in the vertical direction is effected by the rotational direction of the switching knob 83A, such that, consequently, due to the biasing force of spring 87A the position in the vertical direction of the engaging pin 81 contacting the cam surface may change according to the rotational position of the guide portion 84A. As the switching knob 83A rotates in a counterclockwise direction, for example, from its clockwise limit position to its counterclockwise limit position, due to the cam surface providing an anti-biasing force in the upwards direction, the engaging pin 81A may move upward against the downwards biasing force of the biasing spring 87A, such that the engaging pin 81A may reach an upper limit position as shown in FIG. 13. In this position, the anti-biasing force amount acting upwards on the engaging pin 81A provided by the cam surface of the guide portion 84A may reach a maximum. The engaging pin 81A thus positioned at the upper limit position may be distal to the internal gear member 70A and is prevented from interacting with the engaging grooves 74A and the engagement prohibiting surfaces 76A.

On the other hand, as the switching knob 83A rotates in a clockwise direction, for example, from the counterclockwise limit position to its clockwise limit position, the anti-biasing upwards force acting on the engaging pin 81A provided by the cam surface of the guide portion 84A may reach a minimum. Therefore, the engaging pin 81A may move in a manner where the downwards biasing force of the biasing spring 87A is inhibited to a minimal degree by the cam surface of the guide portion 84A, where the pin may reach a lower limit position as shown in FIG. 14. The engaging pin 81A thus positioned at the lower limit position is able to engage any one of the engaging grooves 74A or contact any one of the engagement prohibiting surfaces 76A. Similar to the first embodiment as described above, the engaging pin 81A contacting any one of the engagement prohibiting surfaces 76A may be brought to engage the adjacent engaging groove 74A as the internal gear 70A rotates, depending on the speed.

Also in this second embodiment, it may be possible to achieve a forced rotation mode and a free rotation mode of the polishing pad 100 by the operation of the switching device 80A. In addition, when the engaging pin 81A moves downward as a result of the operation of the switching device 80*a* for changing from the free rotation mode to the forced rotation mode, the engagement prohibiting surfaces 76A may prevent engagement of the engaging pin 81A with the engaging grooves 74A until the rotational speed of the internal gear member 70A is reduced to be lower than a predetermined speed (in other words, until the force applied to the engaging pin 81A in the upward direction by any of the engagement prohibiting surfaces 76A becomes smaller than the downwards biasing force of the biasing spring 87A, analogous to the engagement prohibiting surfaces 76 acting with the biasing spring 87, as described above).

In the second embodiment, the pin engaging portion 73A may be disposed at the upper surface 77A of the internal gear member 70A. Therefore, the pin engaging portion 73A may be positioned on a radially inner side compared to the pin engaging portion 73 of the first embodiment, where the pin engaging portion 73 is disposed on the outer circumferential surface of the internal gear member 70A. As a result, the circumferential speed of the pin engaging portion 73A may be lesser than the circumferential speed of the pin engaging portion 73 of the first embodiment during the rotation of the internal gear 70(70A). In addition, the circumferential speed of the pin engaging portion 73A may vary with a change of the position of the pin engaging portion 73A in the radial direction. Hence, the arrangement of the second embodiment provides a degree of freedom in design of the internal gear member with respect to the circumferential speed of the pin engaging portion 73A.

Third Embodiment

A third embodiment will now be described with reference to FIGS. 16 and 17. Also, the third embodiment is a modification of the first embodiment. Therefore, in FIGS. 16 and 17, like members are given the same reference numerals as the first embodiment, and a description of these members will be omitted. Further, as reference numerals of members that are similar to those of the first embodiment but are somewhat different in construction or shape from them, the reference numerals of the corresponding members of the first embodiment may be used with an alphabet "B" affixed to the last digit of each reference numeral.

A polisher 10B of the third embodiment may be different from the polisher 10 of the first embodiment mainly in the construction relating to a driven shaft member 52B and an eccentric shaft portion 61B. Further in the second embodiment, the polishing pad 100 may be replaced with a polishing pad 90. The construction of an internal gear member 70B may be the same as the construction of the internal gear member 70 of the first embodiment. In addition, the construction of a mode selection device 80B may be the same as the construction of the mode selection device 80.

In the third embodiment, a gear unit 50B may generally include a second bevel gear 51B, the driven shaft member 52B and the internal gear member 70B. The second bevel gear 51B, the driven shaft member 52B and the internal gear member 70B may be disposed within a gear housing 41B. The second bevel gear 51B may engage the first bevel gear 39 (not shown in FIGS. 16 and 17, see FIG. 7). The driven shaft member 52B may include a support shaft portion 53B and the eccentric shaft portion 61B. The second bevel gear 51B may be attached to and supported by the support shaft portion 53B, so that the second bevel gear 51B may rotate together with the support shaft portion 53B about an axis X1. The support shaft portion 53B may have a lower portion with an enlarged diameter portion 54B. The enlarged diameter portion 54B may have a shaft receiving hole 56B having an axis X2 that is offset or displaced from the axis X1. The eccentric shaft portion 61B may be inserted into and rotatably supported within the shaft receiving hole 56B via bearings 631B and 632B, so that the eccentric shaft portion 61B can rotate about the axis X2. In this embodiment, the bearing 631B may be a needle bearing, while the bearing 632B may be a ball bearing. The enlarged diameter portion 54B of the driven shaft member 52B may be rotatably supported by the gear housing 41B via a lower bearing 522B that may be a ball bearing. An upper counterweight 55B may be fixedly attached to the support shaft portion 53B so as to rotate therewith. A lower counterweight 57B may be fixedly attached to the diameter enlarged portion 54B.

In this way, the support shaft portion 53B may rotate about the axis X1, while the eccentric shaft portion 61B may rotate about the axis X2. A mount portion 652B may be formed on the lower end portion of the eccentric shaft portion 61B. The polishing pad 90 may be detachably attached to the mount portion 652B via a screw 93B.

In this embodiment, the polishing pad 90 may have a function similar to that of the polishing pad 100 of the above embodiments. In addition, the polishing pad 90 of this embodiment may have additional functions that may be similar to the functions of the output member 65 and the gear member 69 of the first embodiment. More specifically, the polishing pad 90 may include a pad body 91 configured to be similar in function to the polishing pad 100, an attaching portion 92 configured to be similar in function to the output member 65, and a gear portion 95 configured to be similar in function to the gear member 69. The pad body 91, the attaching portion 92 and the gear portion 95 may be formed integrally with each other. The attaching portion 92 may be attached to the mount portion 652B of the eccentric shaft portion 61B via the screw 93B. The gear portion 95 may be disposed on the upper side of the pad body 91 and may serve to engage the internal gear 71B of the internal gear member 70B. Although not shown in the drawings, a polishing material similar to the polishing sponge 110 of the first embodiment and defining a polishing surface may be detachably attached to the lower surface of the pad body 91 via an appropriate attaching device.

In this embodiment, the support shaft portion 53B may rotate about the axis X1, and the eccentric shaft portion 61B may be supported by the support shaft portion 53B via the bearings 631B and 632B so as to be rotatable about the axis X2 that is displaced or offset from the axis X1. As the eccentric shaft portion 61B rotates about the axis X2, the polishing pad 90 may rotate together with the eccentric shaft portion 61B about the axis X2. In this way, the polishing pad 90 can revolve about the axis X1, while it can rotate about the axis X2. The lower counterweight 57B may cooperate with the upper counterweight 55B for balancing the eccentric motion of the polishing pad 90.

The internal gear member 70B and the mode selection device 80B may be configured to be substantially the same as the internal gear member 70 and the switch device 80 of the first embodiment, respectively. More specifically, the internal gear member 70B may have a substantially ring shape and may be rotatably supported by the gear housing 41B via a bearing 79B. The outer circumferential surface of the internal gear member 70B has an upper half portion and a lower half portion. The lower half portion may fitted with the inner circumferential surface of the bearing 79B. The upper half portion of the outer circumferential surface of the internal gear member 70B may be configured as a pin engaging portion 73B that may include a plurality of engaging grooves 74B spaced equally from each other in the circumferential direction. In this embodiment, twelve engaging grooves 74B are provided. An engaging pin 81B of the mode selection device 80 may be movable in a radial direction towards and away from the internal gear member 70B for engaging with and disengaging from any one of the engaging grooves 74B.

Figure 16:
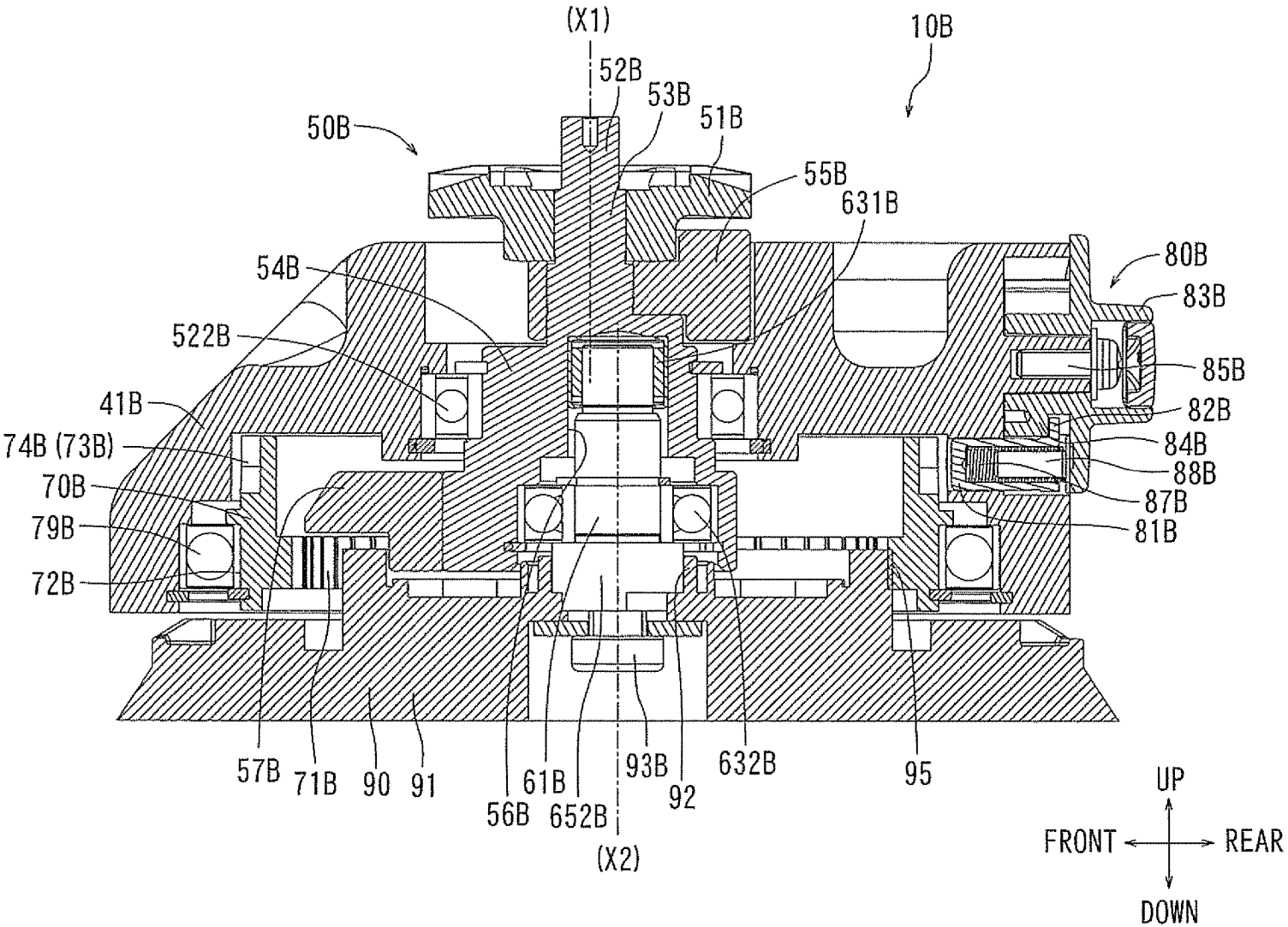
FIG. 16 is a vertical sectional view of a gear unit of a polisher according to a third embodiment.
Figure 17:
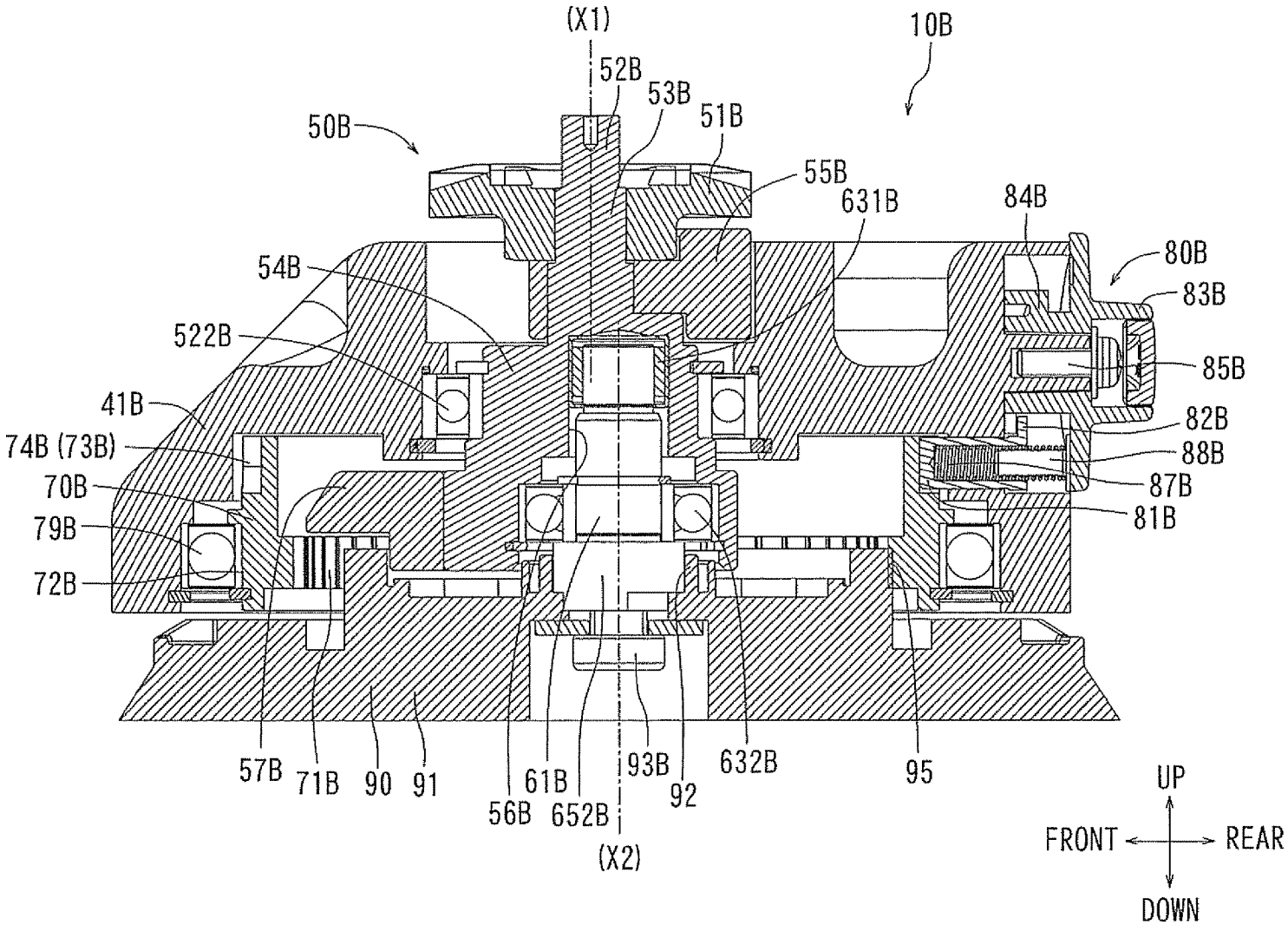
FIG. 17 is a view similar to FIG. 16 but showing the state where an internal gear member is fixed in position in the rotational direction.

Although not shown in FIGS. 16 and 17, separating portions similar to the separating portions 75 of the first embodiment may be each formed between two engaging grooves 74B arranged adjacent to each other in the circumferential direction. Each of the separating portions may have a shape of a projection that protrudes radially outward with respect to the two engaging grooves 74B disposed on its opposite sides. The radially outer surface of each separating portion may be configured as an engagement prohibiting surface similar to the engagement prohibiting surface 76 of the first embodiment.

Fourth Embodiment

Figure 18:
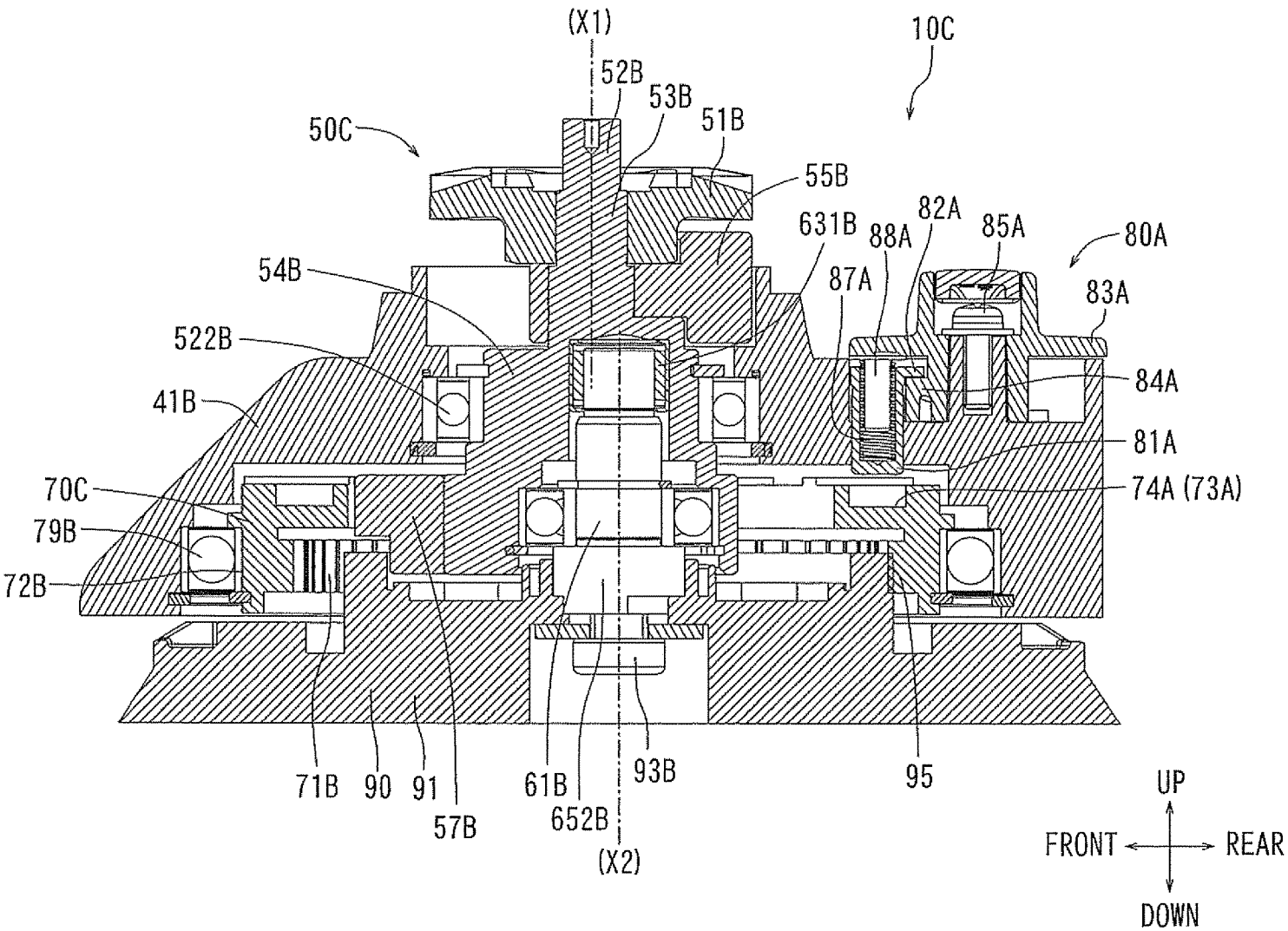
FIG. 18 is a vertical sectional view of a gear unit of a polisher according to a fourth embodiment.
Figure 19:
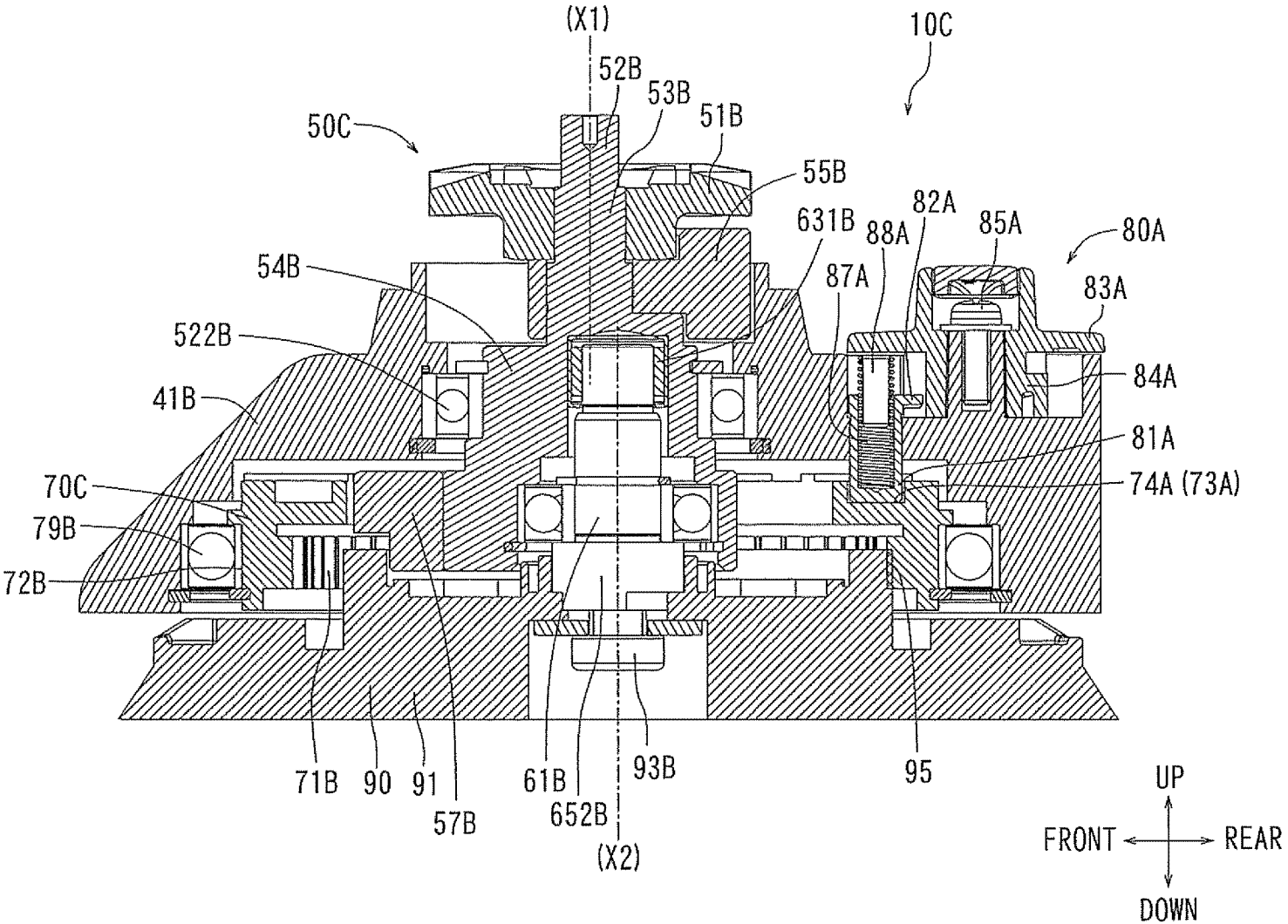
FIG. 19 is a view similar to FIG. 18 but showing the state where an internal gear member is fixed in position in the rotational direction.

A fourth embodiment will now be described with reference to FIGS. 18 and 19. The fourth embodiment is a modification of the third embodiment. Therefore, in FIGS. 16 and 17, like members are given the same reference numerals as the third embodiment, and a description of these members will be omitted. Further, as reference numerals of members that are similar to those of the third embodiment but are somewhat different in construction or shape from them, the reference numerals of the corresponding members of the first embodiment may be used with an alphabet "C" affixed to the last digit of each reference numeral, instead of the alphabet "B".

A polisher 50C according to the fourth embodiment may be similar to the polisher 50B of the third embodiment but may be different from the polisher 50B in that the pin engaging portion 73A and the mode selection device 80A of the second embodiment are incorporated. Thus, a gear unit 50C of the polisher 50C may be similar to the gear unit 50B of the third embodiment but may be different from the gear unit 50B in that an internal gear member 70C has the pin engaging portion 73A. In addition, the mode selection device 80B is replaced with the mode selection device 80A of the second embodiment. Also in this embodiment, it may be possible to achieve the same advantages as the second embodiment in addition to the advantages that may be achieved by the construction of the gear unit 50B and the polishing pad 90 of the third embodiment.

[Possible Modifications]

The above embodiments may be modified in various ways. For example, the gear unit 50 (50A, 50B, 50C) may incorporate any other constructions than those in the above embodiments as long as they can transmit the rotational movement of the motor 32 to the polishing pad 100 (90) as a revolution motion about the axis X1 while allowing rotation of the polishing pad about the axis X2. Further, the engaging mechanism constituted by the engaging pin 81 (81A, 81B) and the pin engaging portion 73 (73A, 73B) may be replaced with any other engaging mechanisms as long as they can engage and disengage the internal gear (71, 71A, 71B).

Representative, non-limiting examples were described above in detail with reference to the attached drawings. The detailed description is intended to teach a person of skill in the art details for practicing aspects of the present teachings and thus is not intended to limit the scope of the invention. Furthermore, each of the additional features and teachings disclosed above may be applied and/or utilized separately or in conjunction with other features and teachings to provide improved polishers, and methods of making and using the same.

Moreover, the various combinations of features and steps disclosed in the above detailed description may not be necessary to practice the invention in the broadest sense, and are instead taught to describe representative examples of the invention. Further, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed as informational, instructive and/or representative and may thus be construed separately and independently from each other. In addition, all value ranges and/or indications of groups of entities are also intended to include possible intermediate values and/or intermediate entities for the purpose of original written disclosure, as well as for the purpose of restricting the claimed subject matter.

What is claimed is:

1. A polisher comprising:

a polishing pad having a polishing surface;

a motor configured to generate a rotational drive force;

an output member coupled to the polishing pad, so that the polishing pad moves with the output member;

a transmission device configured to transmit the rotational drive force of the motor to the output member in a first mode and a second mode;

a mode selection device (1) coupled to the transmission device, (2) configured to allow selection of one of the first mode and the second mode, so that the output member moves according to the selected mode, and (3) includes an engaging member movable between an engaging position and a disengaging position;

an internal gear member; and a transmission housing configured to support the transmission device; wherein:

the mode selection device is disposed at the transmission housing;

the first mode causes the output member to resolve about a first axis and to freely rotate about a second axis displaced from the first axis;

the second mode causes the output member to revolve about the first axis while forcibly rotating the output member about the second axis;

the transmission device comprises:

a support shaft portion configured to be rotatably driven about the first axis by the motor; and an eccentric shaft portion (1) that rotates with the support shaft portion about the first axis when the support shift portion is rotating and (2) defining the second axis, the output member (1) has an external gear portion and (2) is attached to the eccentric shaft portion so as to be rotatable relative to the eccentric shaft portion about the second axis;

the internal gear member (1) is rotatable about the first axis relative to the transmission housing, (2) includes an internal gear portion that is in engagement with the external gear portion of the output member and (3) includes an engaging portion for engagement with the engaging member of the mode selection device;

the first mode causes the engaging member to be disengaged from the engaging portion of the internal gear member to permit rotation of the internal gear member relative to the transmission housing, so that the output member is free to rotate about the second axis while the output member revolves around the first axis;

the second mode causes the engaging member to engage the engaging portion of the internal gear member to prevent rotation of the internal gear member relative to the transmission housing, so that the output member is forced to rotate about the second axis while the output member revolves about the first axis;

the engaging portion of the internal gear member comprises a plurality of engaging grooves formed in a radially outer periphery of the internal gear member;

the engaging member of the mode selection device comprises an engaging pin movable between the engaging position and the disengaging position in a radial direction with respect to a rotational axis of the internal gear member.

2. The polisher according to claim 1, wherein:

the polishing pad is detachably attached to the output member.

3. The polisher according to claim 1, wherein:

the polishing pad is integrated with the output member.

4. A polisher comprising:

a polishing pad having a polishing surface;

a motor configured to generate a rotational drive force;

an output member coupled to the polishing pad, so that the polishing pad moves with the output member;

a transmission device configured to transmit the rotational drive force of the motor to the output member in a first mode and a second mode;

a mode selection device (1) coupled to the transmission device, (2) configured to allow selection of one of the first mode and the second mode, so that the output member moves according to the selected mode, and (3) includes an engaging member movable between an engaging position and a disengaging position;

an internal gear member; and a transmission housing configured to support the transmission device; wherein:

the mode selection device is disposed at the transmission housing;

the first mode causes the output member to revolve about a first axis and to freely rotate about a second axis displaced from the first axis;

the second mode causes the output member to revolve about the first axis while forcibly rotating the output member about the second axis;

the transmission device comprises:

a support shaft portion configured to be rotatably driven about the first axis by the motor; and an eccentric shaft portion (1) that rotates with the support shaft portion about the first axis when the support shift portion is rotating and (2) defining the second axis;

the output member (1) has an external gear portion and (2) is attached to the eccentric shaft portion so as to be rotatable relative to the eccentric shaft portion about the second axis;

the internal gear member (1) is rotatable about the first axis relative to the transmission housing, (2) includes an internal gear portion that is in engagement with the external gear portion of the output member and (3) includes an engaging portion for engagement with the engaging member of the mode selection device;

the first mode causes the engaging member to be disengaged from the engaging portion of the internal gear member to permit rotation of the internal gear member relative to the transmission housing, so that the output member is free to rotate about the second axis while the output member revolves about the first axis;

the second mode causes the engaging member to engage the engaging portion of the internal gear member to prevent rotation of the internal gear member relative to the transmission housing, so that the output member is forced to rotate about the second axis while the output member revolves about the first axis;

the internal gear member further includes an engagement prohibiting portion configured to prohibit engagement of the engaging member with the engaging portion when the engaging member moves from the disengaging position to the engaging portion if the internal gear member rotates at a speed higher than a predetermined speed.

5. The polisher according to claim 4, wherein:

the engagement prohibiting portion is disposed proximally adjacent to the engaging portion in a rotational direction of the internal gear member; and the engagement prohibiting portion includes an inclined surface at a point on the internal gear member, the inclined surface being inclined in a direction opposite to the rotational direction of the internal gear member.

6. The polisher according to claim 5, wherein:

the engaging portion of the internal gear member comprises a plurality of engaging grooves formed on a radially outer periphery of the internal gear member; and the engaging member of the mode selection device comprises an engaging pin movable between the engaging position and the disengaging position in a radial direction with respect to a rotational axis of the internal gear member.

7. The polisher according to claim 5, wherein:

the engaging portion of the internal gear member comprises a plurality of engaging grooves formed on one of two opposing surfaces in an axial direction of the internal gear member; and the engaging member comprises an engaging pin movable between the engaging position and the disengaging position in an axial direction parallel to a rotational axis of the internal gear member.

8. The polisher according to claim 5, wherein the output member comprises an upper tubular portion and a lower tubular portion integrally formed in series.

9. The polisher according to claim 1, further comprising:

a motor housing accommodating the motor and having a longitudinal axis that extends in a front-to-rear direction substantially parallel to the polishing surface of the polishing pad;

a handle housing disposed on a rear side of the motor housing and configured to be grasped by a hand of a user;

a power cord electrically connected to the motor and extending in an extending direction from within a rear portion of the handle housing to an outside of the handle housing;

wherein the extending direction of the power cord is inclined relative to the longitudinal axis of the motor housing by a predetermined angle such that the power cord extends upward away from the polishing surface in a rearward direction.

10. The polisher according to claim 9, wherein the predetermined angle is within a range of about 5 to 90 degrees.

11. The polisher according to claim 10, wherein the predetermined angle is within a range of about 10 to 60 degrees.

12. The polisher according to claim 11, wherein the predetermined angle is 15 degrees.

13. The polisher according to claim 1, further comprising:

a motor housing accommodating the motor and having a longitudinal axis that extends in a front-to-rear direction substantially parallel to the polishing surface of the polishing pad a handle housing disposed on a rear side of the motor housing and configured to be grasped by a hand of a user;

a power cord electrically connected to the motor and extending in an extending direction from within a rear portion of the handle housing to an outside of the handle housing;

a holding sleeve pivotally coupled to the rear portion of the handle housing to allow adjustment of a tilt angle of the holding sleeve in a vertical direction relative to the polishing surface;

wherein the power cord extends from the rear portion of the handle housing to the outside of the handle housing through the holding sleeve.

14. A polisher comprising:

a polishing pad having a polishing surface;

a motor configured to generate a rotational drive force;

an output member (1) coupled to the polishing pad, so that the polishing pad moves with the output member, and (2) including an external gear that is revolvable around a first axis and rotatable about a second axis displaced from the first axis;

a transmission device configured to transmit the rotational drive force of the motor to the output member in any one of a plurality of different modes;

a mode selection device coupled to the transmission device and configured to allow selection of one of the plurality of different modes, so that the output member moves according to the selected mode;

an engaging member;

a prohibition device;

a transmission housing configured to support the transmission device; and an internal gear selectively rotatable about the first axis relative to the transmission housing and being in engagement with the external gear; wherein:

the engaging member is configured to engage and disengage the internal gear for preventing and permitting rotation of the internal gear relative to the transmission housing; and the prohibition device is configured to prohibit the engaging member from engagement with the internal gear if the internal gear member rotates at a speed higher than a predetermined speed.

15. A polisher comprising:

a polishing pad having a polishing surface;

a motor configured to generate a rotational drive force;

an output member coupled to the polishing pad, so that the polishing pad moves with the output member;

a transmission device configured to transmit the rotational drive force of the motor to the output member in any one of a plurality of different modes with respect to a motion of the output member;

a mode selection device coupled to the transmission device and configured to allow selection of one of the plurality of different modes, so that the output member moves according to the selected mode;

a transmission housing configured to support the transmission device;

a motor housing accommodating the motor and having a longitudinal axis that extends in a front-to-rear direction substantially parallel to the polishing surface of the polishing pad;

a handle housing disposed on a rear side of the motor housing and configured to be grasped by a hand of a user; wherein:

the mode selection device is disposed at the transmission housing; and the motor has an axis extending in the front-to-rear direction.

16. The polisher according to claim 15, wherein the handle housing has a longitudinal direction that is inclined to approach a plane of the polishing surface as the handle extends rearward from the motor housing.

17. The polisher according to claim 15, further comprising a control configured to control the motor and disposed within the handle housing.

* * * * *